US009637872B1

(12) United States Patent
Pedersen et al.

(10) Patent No.: US 9,637,872 B1
(45) **Date of Patent: *May 2, 2017**

(54) METHODS FOR PAVING A TRAIL BETWEEN OBSTACLES

(71) Applicant: GOMACO Corporation, Ida Grove, IA (US)

(72) Inventors: Scott Pedersen, Rockwell City, IA (US); James Hayward, Peoria, AZ (US)

(73) Assignee: GOMACO Corporation, Ida Grove, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/395,851

(22) Filed: Dec. 30, 2016

Related U.S. Application Data

(60) Continuation of application No. 15/221,190, filed on Jul. 27, 2016, now Pat. No. 9,567,715, which is a division of application No. 14/610,241, filed on Jan. 30, 2015, now Pat. No. 9,428,869.

(60) Provisional application No. 62/068,418, filed on Oct. 24, 2014.

(51) Int. Cl.

| | |
|---|---|
| ***E01C 15/00*** | (2006.01) |
| ***E01C 19/00*** | (2006.01) |
| *E01C 19/48* | (2006.01) |
| *E01C 19/22* | (2006.01) |

(52) U.S. Cl.
CPC ..... *E01C 15/00* (2013.01); *E01C 19/004* (2013.01); *E01C 19/22* (2013.01); *E01C 19/48* (2013.01)

(58) Field of Classification Search
CPC ..... B62D 53/00; B62D 53/02; E01C 19/00; E01C 2019/2075
USPC ..... 180/235, 417
See application file for complete search history.

(56) References Cited

U.S. PATENT DOCUMENTS

| | | | | |
|---|---|---|---|---|
| 1,999,748 A | | 4/1935 | Baratelli | |
| 2,618,083 A | * | 11/1952 | Armington | E02F 3/7695 37/389 |
| 3,237,790 A | | 3/1966 | Kampert et al. | |
| 3,537,363 A | * | 11/1970 | Long | F15B 9/09 404/108 |
| 3,710,695 A | * | 1/1973 | Miller | E01C 19/4893 180/434 |
| 3,749,505 A | | 7/1973 | Miller et al. | |
| 3,807,586 A | | 4/1974 | Holopainen | |
| 3,838,932 A | | 10/1974 | Glenewinkel | |
| 3,982,338 A | * | 9/1976 | Dick | E02F 3/6445 37/463 |
| 4,012,160 A | * | 3/1977 | Parker | E01C 19/4873 404/84.05 |
| 4,140,193 A | | 2/1979 | Miller | |
| 4,620,717 A | | 11/1986 | Ivony et al. | |

(Continued)

*Primary Examiner* — Thomas B Will
*Assistant Examiner* — Katherine Chu
(74) *Attorney, Agent, or Firm* — Suiter Swantz pc llo

(57) ABSTRACT

Methods and apparatuses for continuous paving near or around obstacles that are along a path to be paved. The methods include receipt of paving materials onto a material conveyor then into a hopper, detecting an amount of paving materials received in the hopper, indicating whether the paving materials in the hopper are sufficient for paving around an obstacle, forming the paving materials into a paved trail of widths from one to four meters, and moving the material conveyor while the trail paver continuously paves around the obstacle.

20 Claims, 14 Drawing Sheets

(56) References Cited

U.S. PATENT DOCUMENTS

| | | | | |
|---|---|---|---|---|
| 4,749,304 | A | 6/1988 | Craig | |
| 4,789,266 | A * | 12/1988 | Clarke, Jr. | E01C 19/187 404/104 |
| 4,861,191 | A * | 8/1989 | Smith | E01C 19/185 404/101 |
| 5,452,966 | A * | 9/1995 | Swisher, Jr. | E01C 19/48 404/108 |
| 5,484,226 | A * | 1/1996 | Emerson | E01C 19/48 404/108 |
| 6,109,825 | A | 8/2000 | Yon | |
| 6,193,257 | B1 | 2/2001 | Lutz | |
| 6,193,438 | B1 | 2/2001 | Heims | |
| 6,422,785 | B1 * | 7/2002 | Ruggles | E01C 19/182 198/317 |
| 6,460,643 | B1 | 10/2002 | Degelman | |
| 6,582,152 | B2 * | 6/2003 | Leone | E01C 19/42 404/105 |
| 6,872,028 | B2 * | 3/2005 | Aeschlimann | E01C 19/40 404/101 |
| 6,890,123 | B2 | 5/2005 | Piccoli | |
| 7,377,719 | B1 | 5/2008 | Elizondo et al. | |
| 7,484,911 | B2 * | 2/2009 | Frelich | E01C 19/48 222/71 |
| 8,002,074 | B2 | 8/2011 | Roose | |
| 8,337,118 | B2 | 12/2012 | Buschmann et al. | |
| 8,573,886 | B1 | 11/2013 | Taylor, Jr. | |
| 8,807,261 | B2 | 8/2014 | Subrt et al. | |
| 9,016,423 | B2 | 4/2015 | Wetterich | |
| 9,108,674 | B2 | 8/2015 | Thoren et al. | |
| 9,180,909 | B1 | 11/2015 | Coats et al. | |
| 9,428,869 | B2 | 8/2016 | Pedersen | |
| 2005/0058507 | A1 * | 3/2005 | Musil | E01C 19/185 404/108 |
| 2007/0231069 | A1 | 10/2007 | Buschmann | |
| 2007/0250236 | A1 | 10/2007 | Newberry et al. | |
| 2008/0292398 | A1 | 11/2008 | Potts | |
| 2009/0151313 | A1 | 6/2009 | Dillon | |
| 2010/0178107 | A1 | 7/2010 | Braddy et al. | |
| 2011/0016756 | A1 * | 1/2011 | Schmidt | E02F 3/325 37/403 |
| 2011/0318102 | A1 | 12/2011 | Utterodt et al. | |
| 2012/0051839 | A1 | 3/2012 | Begley et al. | |
| 2012/0059549 | A1 | 3/2012 | Noel | |
| 2012/0128417 | A1 | 5/2012 | Zimmermann et al. | |
| 2012/0288328 | A1 | 11/2012 | Minich | |
| 2013/0051914 | A1 | 2/2013 | Buschmann | |
| 2013/0264785 | A1 | 10/2013 | Bullis | |
| 2014/0099165 | A1 * | 4/2014 | Smieja | E01C 19/48 404/72 |
| 2014/0110184 | A1 | 4/2014 | Oberg et al. | |
| 2014/0154010 | A1 | 6/2014 | Steinhagen | |
| 2014/0286706 | A1 | 9/2014 | Klockner | |
| 2014/0343813 | A1 | 11/2014 | Morselli et al. | |
| 2015/0104255 | A1 | 4/2015 | Musil | |
| 2016/0114833 | A1 | 4/2016 | Hukkanen | |
| 2016/0251042 | A1 | 9/2016 | Guntert, Jr. et al. | |

* cited by examiner

METHODS FOR PAVING A TRAIL BETWEEN OBSTACLES

CROSS-REFERENCE TO RELATED APPLICATION

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)).

Related Applications

For purposes of the USPTO extra-statutory requirements, the present application constitutes a continuation application of U.S. application Ser. No. 15/221,190, entitled ADJUSTABLE WIDTH TRAIL PAVER, naming Scott Pedersen and James Hayward as inventors, filed Jul. 27, 2016, which constitutes a divisional application of U.S. Pat. No. 9,428,869, entitled ADJUSTABLE WIDTH TRAIL PAVER, naming Scott Pedersen and James Hayward as inventors, filed Jan. 30, 2015, issued Aug. 30, 2016, which constitutes a regular (non-provisional) patent application of U.S. Provisional Patent Application No. 62/068,418, entitled ADJUSTABLE WIDTH TRAIL PAVER, naming Scott Pedersen and James Hayward as inventors, filed Oct. 24, 2014.

FIELD OF THE INVENTION

The present invention is directed generally toward paving machines, and more particularly toward paving machines having adjustable widths and movable conveyors.

BACKGROUND OF THE INVENTION

Trail and sidewalk paving can be required in almost any terrain. Often, new residential communities enter into contractual arrangements for trails, sidewalks, or paved paths. Contractual arrangements for paving do not always precede arrangements establishing fixtures, such as light poles and trees, along a path to be paved. Furthermore, contracts are individualized and may require various paving dimensions. If the contract for paving generates from well-established areas, the number of fixtures and general obstructions along the path to be paved significantly increases.

In meeting these contractual arrangements, machines that pave only a pre-determined width are obviously limited, and machines that pave multiple widths but pave only intermittently between periods of material loading are also limited. Additionally, machines that pave continuously, but are inaccessible to material loading trucks are also limited.

Often, access to pavers requires delivery trucks to damage surrounding terrain (i.e., landscaping, curbs, etc.) during paving. Often continuous paving is interrupted to load materials, circumnavigate obstacles, or remove obstructions along the paving path. Often multiple passes are required to complete the required paving. Consequently, it would be advantageous if an apparatus existed that provides various paving widths, provides increased versatility in the tasks it performs, provides increased maneuverability with minimum to zero clearance, provides increased access to material loading trucks despite obstructions near the path to be paved, and provides varying degrees of operating modes (e.g., manual, automatic, or partially-automatic).

SUMMARY

Accordingly, the present disclosure is directed to novel methods and apparatuses for adjustable width paving and moveable and controllable access to paving materials from loading trucks.

Embodiments of the present disclosure are directed to a method for continuously paving a trail between obstacles using an adjustable width trail paver. In one aspect, the method includes receiving paving material onto a moveable controllable material conveyor. In another aspect, the method includes receiving paving material into a material hopper that is in communication with the moveable controllable material conveyor. In another aspect, the method includes configuring the material hopper to receive sufficient material to enable continuous paving while the material conveyor is being moved or controlled around the obstacle. In another aspect, configured the material hopper includes configuring the material hopper to receive paving material from said material conveyor, detect the amount of paving material received, indicate that more or less paving material is needed to pave around said obstacle, and discharge paving material to a paving material former. In another aspect, the method includes receiving paving material into the paving material former to form a paved trail of widths from one meter to four meters. In another aspect, the method includes moving the material conveyor when an obstacle is in a path of the material conveyor.

Further embodiments of the present disclosure are directed to a method for one-pass, or multiple-pass paving of a trail between obstacles. In one aspect, the method includes receiving paving material into a material hopper of a trail paver, where the material hopper is in communication with a moveable controllable material conveyor and with a paving material former. In another aspect, the method includes mounting the paving material former to a rear end of a prime mover. In another aspect the method includes mounting a subgrade preparing component to a front end of the prime mover. In another aspect, the method includes performing a subgrade preparation step simultaneously while the paving material former is forming the paving material into a paved trail. In another aspect, the method includes moving the material conveyor when an obstacle is in the path of the material conveyor so that the trail paver continuously paves past the obstacle.

Further embodiments of the present disclosure are directed to a method for adjustable width trail paving between obstacles. In one aspect, the method includes receiving paving material by one or more components of a trail paver, where the one or more components are in communication with each other. The one or more components may include at least a material hopper, a moveable controllable material conveyor, and an adjustable width paver. In another aspect, the method includes receiving paving material into the adjustable width paver to form a paved trail of widths from one meter to four meters. In another aspect, the method includes adjusting one or more component widths to form the paved trail widths. In another aspect, the method includes rotating, tilting, or folding the material conveyor when an obstacle is in a path of the material conveyor. In another aspect, the method includes configuring the material hopper to receive sufficient material to enable continuous paving while the material conveyor is being moved or controlled around the obstacle. In another aspect the method includes forming paving materials according to one or more pre-determined dimensions to form the paved trail.

Further embodiments of the present disclosure are directed to a paving machine comprising a frame, a prime mover, a moveable and controllable conveyor, an adjustable width paver, and one or more additional paving components, including, for example, a stringless guidance system for automated control. Various combinations of the above-listed embodiments are also contemplated by this disclosure.

BRIEF DESCRIPTION OF THE DRAWINGS

The numerous advantages of the present invention may be better understood by those skilled in the art by reference to the accompanying figures in which.

DETAILED DESCRIPTION

Reference will now be made in detail to the subject matter disclosed, which is illustrated in the accompanying drawings. The scope of this disclosure is limited only by the claims; numerous alternatives, modifications and equivalents are encompassed. The use of "or" is meant to be inclusive, unless otherwise indicated. Additionally, when used herein to join items in a list, "or" denotes "at least one of the items," but does not exclude a plurality of items in the list. For the purpose of clarity, technical material that is known in the technical fields related to the embodiments has not been described in detail to avoid unnecessarily obscuring the description.

Accordingly, while the present invention is described in detail in relation to one or more embodiments, it is to be understood that this disclosure is illustrative and exemplary of the present invention, and is made merely for the purposes of providing a full and enabling disclosure of the present invention. The detailed disclosure of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Figure 1:
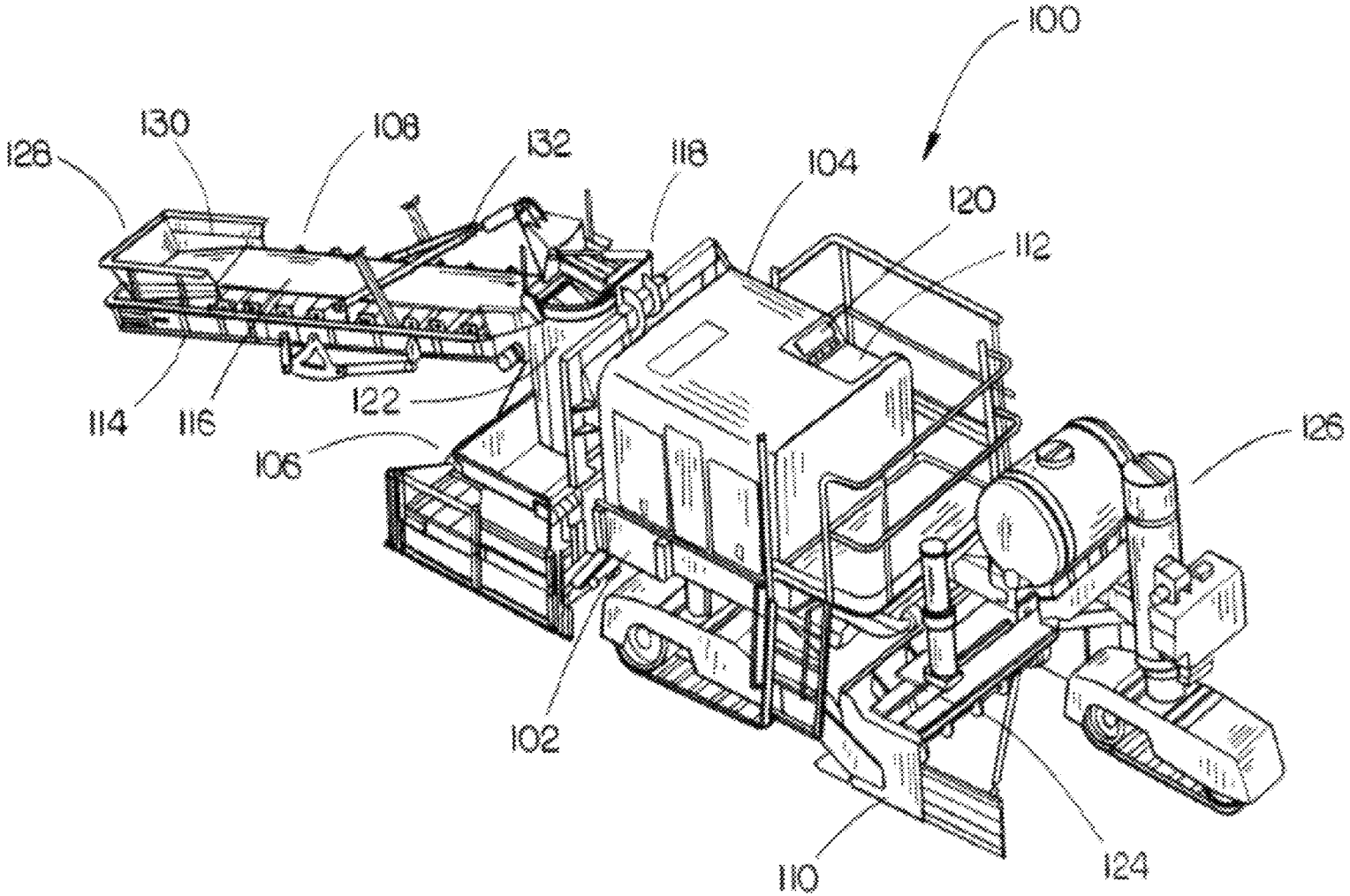
FIG. 1 shows an adjustable width paver according to embodiments of this disclosure including a base mold, an adjustable width paver, and a moveable and controllable conveyor.

Referring to FIG. 1, an adjustable width paving machine 100 comprising a frame 102, a prime mover 104, an adjustable width paver 106, and a moveable and controllable materials conveyor 108 is illustrated. The adjustable width paver 106 is rear-end mountable to a rear end of the prime mover 104. The location helps provide the ability of one-, two-, or three-pass paving. Additionally, the moveable and controllable aspects of the materials conveyor help provide one-, two-, or three-pass continuous paving.

The frame 102 has a longitudinal axis and is adapted to be moved in a forward direction (i.e., in the general paving direction). The frame 102 is further adapted to be operably connected to (or in connection with) the prime mover 104, and connected to (or in connection with) various paving components, including, but not limited to, the adjustable width paver 106, the materials conveyor 108, the base mold 110, the trimmer 202, leg 126, and additional paving components contemplated herein. In embodiments the frame 102 is integrated with prime mover 104, such that it is a part of it, meaning the frame 102 and prime mover 104 comprise two parts of a whole, undivided unit.

In embodiments, the prime mover includes a motor and transmission (not shown). For example, the motor is a 59.7-74.6 KW (80-100 HP) diesel engine.

In embodiments, the frame 102 has a plurality of support structures 126. In further embodiments, the support structures 126 are legs; and, in yet further embodiments the legs have tracks. The tracks are capable of movement and steering according to embodiments herein. In yet further embodiments, the legs have rubber tires. If configured correctly, the leg(s) 126, the prime mover 104, the frame 102, the adjustable width paver 106, the base mold 110, the trimmer 202, and the materials conveyor 108 work together to achieve one-, two-, or three-pass paving.

The ability to achieve one-, two-, or three-pass paving depends in part on the amount of subgrade or subbase preparation required. In embodiments of this disclosure, a trimmer and an adjustable width paver are operated simultaneously (or substantially simultaneously). In further embodiments, a base mold and the adjustable width paver are operated simultaneously (or substantially simultaneously). In embodiments the trimmer, base mold, and the adjustable width paver can be fixed or detachable; in embodiments, being detachable helps enable the simultaneous or substantially simultaneous capabilities of the adjustable width trail paver. The simultaneous or substantially simultaneous operation of these components help enable one-, two-, or three-pass continuous paving, depending on the amount of subgrade or subbase preparation required.

For example, if the composition of subgrade material is such that once precise trimming is performed the paving materials (e.g., cement) can be placed directly on top of the trimmed path, then using the trimmer 202 (FIG. 2) and adjustable width paver 106 simultaneously enables one-pass paving. If the subgrade is such that it does not need to be trimmed, but only requires at least one layer of subbase or subgrade material (e.g., aggregate base), then using a rock box, or the base mold 110, and the adjustable width paver 106 simultaneously enables one-pass paving. If both trimming and at least one layer of subbase or subgrade material is required, then utilizing the trimmer 202, followed by the base mold 110 and adjustable width paver 106 simultaneously, enables two-pass paving. If two or more types of trimmer teeth are necessary to achieve the desired grade, then three-pass trimming is achieved by interchanging trimmerhead teeth after a first pass, followed by the base mold and adjustable width paver operated simultaneously or substantially simultaneously. This example is for illustrative purposes only, as there may be many different combinations that enable one-, two-, or three-pass paving, or additional-pass paving.

In embodiments, the ability to achieve one-, two-, or three-pass continuous paving depends in part on the use of the moveable controllable materials conveyor. As the adjustable width trail paver paves a path, obstacles may be along the path to be paved. The materials conveyor is moved around the obstacles, and a hopper in communication with the materials conveyor has sufficient paving materials to continuously pave even while the materials conveyor is moved. In embodiments, the hopper is a single receiving and discharging hopper. In further embodiments, it is a series of hoppers within a single enclosure working in communication to receive and discharge materials. In yet further embodiments, the hopper is a series of separate hoppers working in communication to receive and discharge the paving materials.

Additionally, the ability to achieve one-, two-, or three-pass continuous paving depends in part on the location of the various components of the adjustable width trail paver. For example, numerous paving machines include a paver mounted directly or indirectly to the undercarriage of the prime mover. This substructure location often limits the versatility of the prime mover in performing multiple paving tasks including preparing subgrade, subgrade materials, and subbase materials. In contrast, in embodiments of this disclosure, the rear end mounting capabilities of the detachable or fixed adjustable width paver 106 frees the front end of the prime mover for other detachable or fixed paving components (e.g., base mold or trimmer). In embodiments, the detachable or fixed paving components are utilized to prepare the subgrade, subgrade materials, or subbase materials. The preparation includes, but is not limited to, trimming the subgrade and molding and compacting subgrade or subbase material such as gravel or aggregate base materials.

Figure 2:
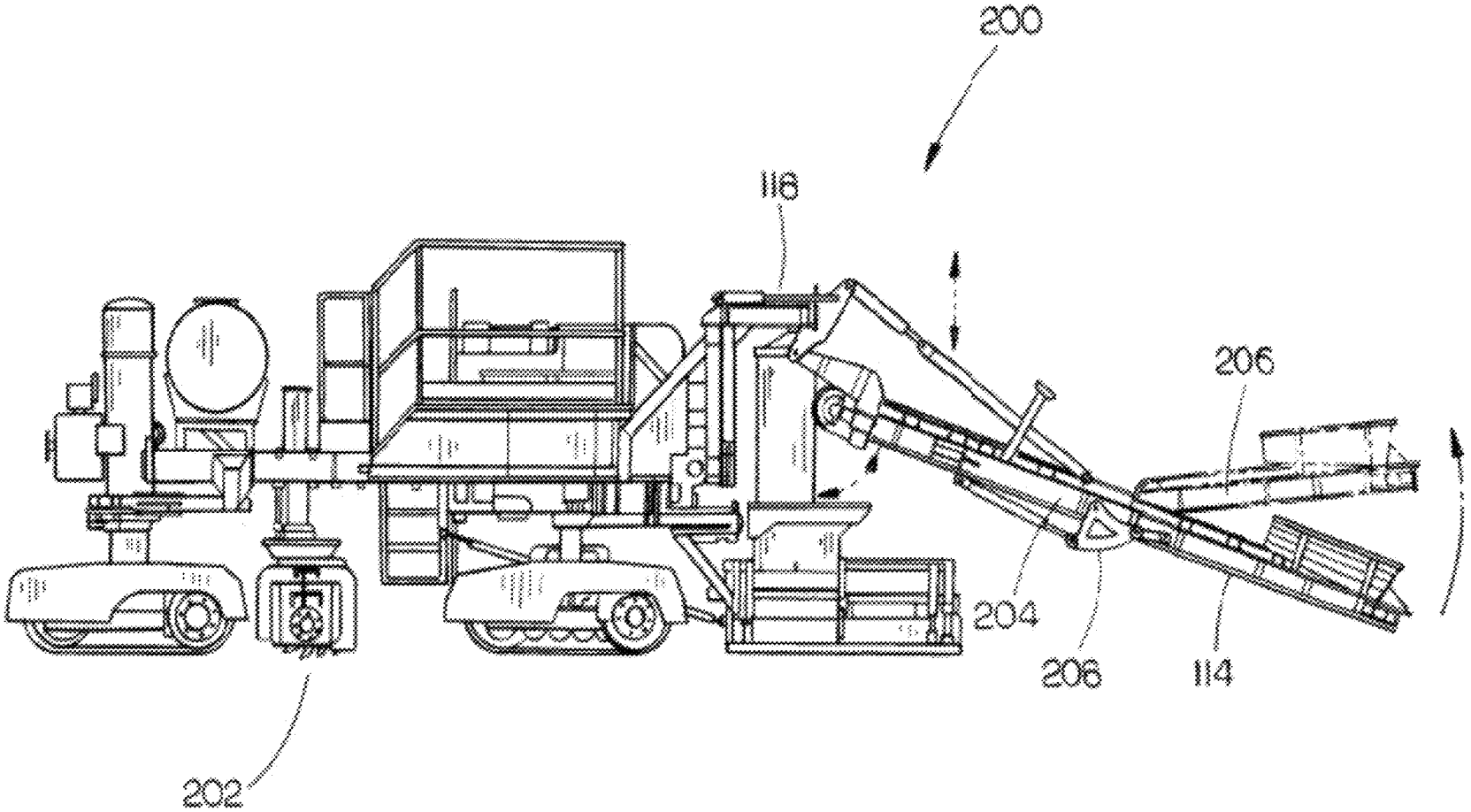
FIG. 2 shows an adjustable width paver according to embodiments having a trimmer and a moveable controllable conveyor that can be tilted, elevated/raised, or folded.

In embodiments, the preparation of the subgrade is achieved by a trimmer. Referring to FIG. 2, an adjustable width paving machine 200 having a moveable and controllable conveyor 108 and a trimmer 202 is illustrated. The trimmer 202 includes capabilities such as side shift and height adjustment. In embodiments, the trimmer may include additional capabilities such as width adjustment. In embodiments the side shift and height adjustment are hydraulically achieved. In further embodiments, the side shift, height, and width adjustment may be hydraulically achieved. The trimmer also includes a single-drive, hydrostatic motor, which is internal to the trimmer design. The internal motor and front-mounted location of the trimmer further enable the compact size and zero-clearance capabilities of the adjustable width trail paver. In further embodiments, the trimmer includes a conveyor system (not shown in FIG. 2) that is a closed loop direct drive hydrostatic system, for conveying trimmed materials away from the path to be paved.

In further embodiments, the trimmer comprises numerous teeth to do the trimming. The teeth may vary according to the subgrade composition. For example, the teeth might include carbide-tipped or carbide-tipped asphalt teeth for cement-treated base, soil stabilization, and other tough trimming applications. In embodiments, the trimmer is either detachable or fixed to the prime mover. In embodiments, the trimming is performed prior to, simultaneous with, or substantially simultaneous with the paving. In embodiments, the trimmer width may be adjusted by adding or subtracting one or more teeth segments/inserts from the trimmer.

In embodiments, the preparation of the subgrade is achieved by a base mold. Referring again to FIG. 1, the base mold 110 includes one or more spreader, one or more compaction pan, and a base mold (e.g., an aggregate base mold). In embodiments the spreader is a rotating, spreader auger 124. In further embodiments the spreader is some other spreading means, including a spreader plow or its equivalents (not shown in figure). In embodiments the compaction pan is a three- to six-pan vibrator, which prepares and compacts the subgrade materials (such as aggregate base) before paving. In further embodiments, the compaction pan does not include vibrators, but does include equivalent compacting means (e.g., weight of compactor).

In embodiments, subgrade or subbase material, is placed in front of the adjustable width paver 100. The spreader auger 124 rotates at adjustable speeds of from 40 to 80 rpm to spread the subgrade or subbase material prior to, simultaneous with, or substantially simultaneous with paving (i.e., hydraulically adjustable width paving or slipform paving). The speed of the spreader auger 124 is adjusted to account for factors known in the art, including, but not limited to: speed of operation, desired depth of subbase/subgrade material, and composition of subbase/subgrade material.

Figure 3:
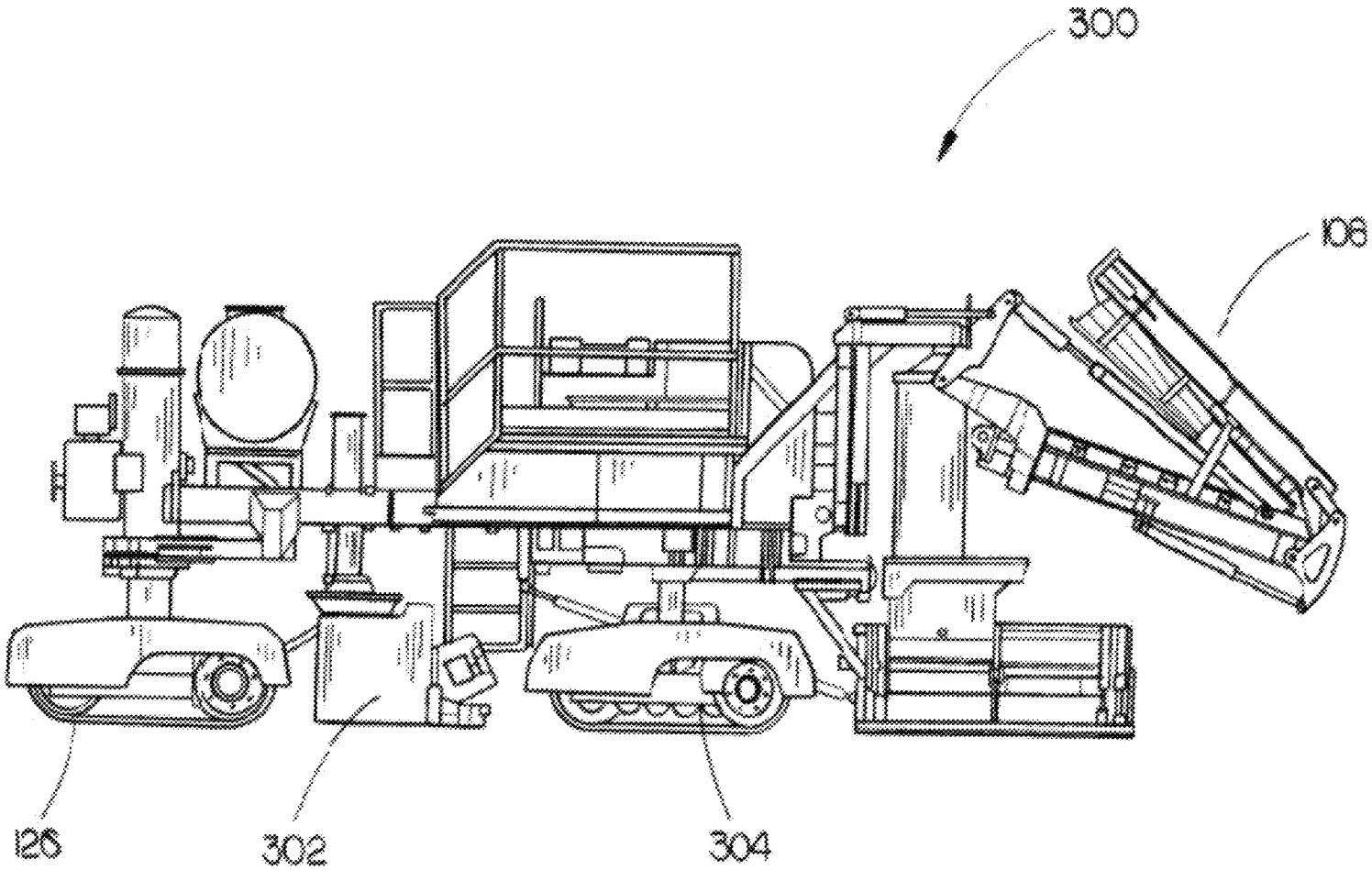
FIG. 3 shows an adjustable width paver according to embodiments having a folded conveyor and a compaction pan (with or without vibrators)

Referring to FIG. 3, an adjustable width paving machine 300 having a fully folded or nearly fully folded conveyor 108 and a compaction pan 302 is illustrated. The compaction pan 302 may be detachable and separate from the base mold 110, or the compaction pan may be integrated together with the base mold 110 so that they may be used simultaneously. As used herein, the term "compaction pan" means a trailing pan having three to six pan-type vibrators incorporated therein. The compaction pan 302 enables preparation and compaction of subgrade materials prior to paving. In embodiments, the preparation and compaction of the subgrade materials is immediately before paving.

In embodiments the base mold 110 includes capabilities such as side shift, and height and adjustment. In further embodiments the base mold may include capabilities such as side shift, height, and width adjustment. In embodiments, the side shift and height adjustment are hydraulically achieved. In further embodiments, the width and height adjustment is achieved by two or more interchangeable molds having differing dimensions, for example differing width or and height dimensions.

In embodiments, the preparation of the subgrade is immediately before paving, whereas "immediately before" means the preparation of the subgrade is substantially simultaneous with the paving (i.e., preparation and paving performed in the same pass). The preparation of subgrade immediately before paving is in part enabled by the location of the front-end mountable base mold 110 or trimmer 202, and the rear-end mountable location of the adjustable width paver 106.

Figure 5:
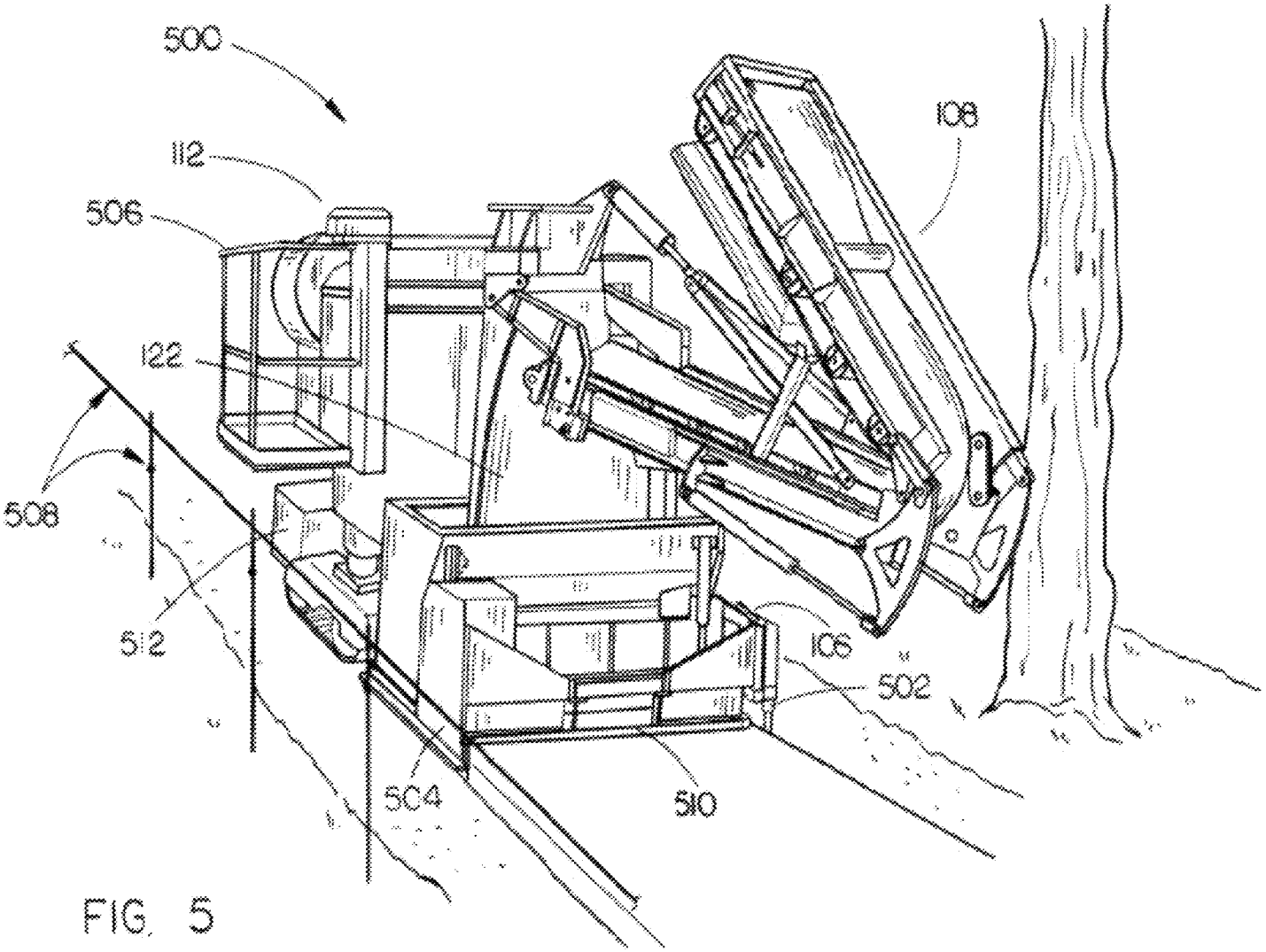
FIG. 5 shows an adjustable width paver according to embodiments having a folding conveyor that is controlled or moved to avoid obstacles and a folding operator walkway.

In embodiments, the adjustable paving widths are achieved by various paving formers, the paving formers including, but not limited to, a paving mold, a paving pan, a slipform mold, an adjustable width paver 106, or adjustable pressure compensated side plates 502 and 504 (FIG. 5). In embodiments, the pressure compensated side plates 502 and 504 are integrated together with the adjustable width paver 106 and are hydraulically adjustable to achieve varying paving widths. In further embodiments, the varying paving widths are achieved by two or more interchangeable slipform paving molds (not shown in figures) having different dimensions, for example, different height, width, or depth dimensions. In embodiments, the varying paving widths include, but are not limited to, paving widths of from one to four meters. In further embodiments, paving widths include from 1.5 m (5 ft.), 2.44 m (8 ft.), 3 m (10 ft.), to 3.66 m (12 ft.). In further embodiments, the paving molds or paving pans are used in conjunction with the pressure compensated side plates; the pressure compensated side plates integrated with the paving molds or pans such that they are operably considered a single unit.

According to embodiments, the pressure compensated side plates 502 and 504 help ensure accurate dimensions and finishing. In embodiments the pressure compensated side plates 502 and 504 compensate for forces exerted by the paving materials. In embodiments, the compensation may be achieved by the materials from which side plates 502 and 504 are constructed and the manner in which they are constructed. For example, forces exerted by paving materials may be compensated for by utilizing compensating material or compensating forces, including, but not limited to: reinforced steel (or other similar carbon steel, metal, or alloy) to construct the side plates; hydraulics; springs (which may be a compensating material which generates a compensating force); or other operable equivalents; or, by utilizing different combinations of the compensating materials or compensating forces.

Again referring to FIG. 1, in embodiments, a leg or support structure 126 can be hydraulically expanded (i.e., adjusted laterally) up to 0.9144 m (36 in.). In further embodiments, the hydraulically expanding leg is one or both of the rear track drive assemblies 304 (FIG. 3); wherein, one of the rear track drive assemblies 304 can be hydraulically expanded (i.e., adjusted laterally) up to 0.9144 m (36 in.). In further embodiments, the adjustable width paving machine 100 includes one or more inserts to enable paving at various widths. In yet further embodiments, the inserts are paving pan inserts of varying sizes to compensate for the hydraulic expansion, including, but not limited to, 0.635 cm (¼ in.), 1.27 cm (½ in.), 7.62 cm (3 in.), 15.24 cm (6 in.), inserts, or larger. In embodiments, a leg 126 is excluded from the adjustable width trail paver, such that only the rear track drive assemblies provide support, steering, and movement to the frame 102 and prime mover 104.

In embodiments, a leg (e.g., 126 or one or both of 304) is integrated with the frame 102 so that the hydraulic expansion actually occurs within the frame and is not confined to the leg. This results in a hydraulically expandable frame 102 that can generally be expanded up to 0.9144 m (36 in.), or from two to 100 centimeters. This range including from 2 cm to 100 cm. In further embodiments, the hydraulically expandable frame also incorporates paving pan inserts of varying sizes to ensure the paving pan spans the entire width to be paved. Varying sizes including, but not limited to, 0.635 cm (¼ in.), 1.27 cm (½ in.), 7.62 cm (3 in.), 15.24 cm (6 in.), pan inserts, or larger. Again, any of the legs/support structures may be used as the hydraulically expanding leg/support structure.

Further embodiments of the present disclosure are directed to an adjustable width trail paver having a moveable and controllable materials conveyor 108 operably and controllably connected to an operator control 112. The operator control 112 having tilt, raise, pivot, and fold features enabling an operator to control the conveyor drive and move the materials conveyor around obstacles that are near the path to be paved.

The operator control 112 further comprising a control panel 120, memory storage, processing and computing means, programmed instructions, and two-way communication connection means. The operator control 112 is communicatively connected to at least the prime mover 104, the conveyor 108, the adjustable width paver 106, the discharge hopper 122, the base mold 110 or trimmer 202, and one or more additional paving components to create a one-point control center to actuate and control each component of the adjustable width paver. In embodiments, programmed instructions are stored in memory storage accessed by an operator to help the operator move, actuate, and control each component. In further embodiments, programmed instructions are stored in memory storage accessed by the operator control 112 to enable automatic or partially-automatic control of the adjustable width trail paver.

In embodiments, the operator control 112 further comprises self-diagnostic features. The self-diagnostic features may locate a problem and engage embedded software to correct the problem, or may generate a signal to alert an operator that a problem exists needing attention or repair.

The two-way communication connection means of the operator control 112 may be any communication connection means known in the art, for example, Bluetooth, wired, wireless, or CAN-Bus communication connection means.

The operator control 112 may comprise any display and input/output means generally known in the art. For example, the operator control 112 may include a control panel 120 which further comprises an operator input device or a display for displaying data to an operator and receiving operator input instructions. For example, the operator input device may include, but is not limited to, a keyboard, a keypad, a touchscreen, a lever, a knob, a scroll wheel, a track ball, a switch, a dial, a sliding bar, a scroll bar, a slide, a handle, a touch pad, a paddle, a steering wheel, a joystick, a bezel input device or the like. The display device may include any display device known in the art. In one embodiment, the display device may include, but is not limited to, a liquid crystal display (LCD). In another embodiment, the display device may include, but is not limited to, an organic light-emitting diode (OLED) based display. In another embodiment, the display device may include, but is not limited to a CRT display. In a general sense, any display device capable of integration with an operator interface device (e.g., touchscreen, bezel mounted interface, keyboard, mouse, trackpad, and the like) is suitable for implementation in the present disclosure. In the case of a touchscreen interface device, those skilled in the art should recognize that a large number of touchscreen interface devices may be suitable for implementation in the present disclosure. For instance, the display device may be integrated with a touchscreen interface, such as, but not limited to, a capacitive touchscreen, a resistive touchscreen, a surface acoustic based touchscreen, an infrared based touchscreen, or the like. In a general sense, any touchscreen interface capable of integration with the display portion of the display device is suitable for implementation in the present disclosure.

In embodiments, the display includes one or more auto control gauges for monitoring the operator control 112 and its various signals as the adjustable width paving machine follows a stringline or a predetermined course. In embodiments, the auto control gauges are configured to allow monitoring control signals as the machine follows a stringline. In further embodiments, the auto control gauges are configured to allow monitoring of control signals as the adjustable width trail paver follows a predetermined course in accordance with a stringless guidance system. In further embodiments the display includes one or more emergency stop controls. In embodiments, software for slope transition is available and features automatic correction for grade elevation, automatic correction for steering, and eliminates the need for stringline adjustment.

In embodiments, the moveable controllable materials conveyor comprises a structural framework assembly 114, belt conveying means 116, and a connection point 118. In embodiments, connection point 118 (FIG. 2) comprises a plurality of connection points along or generally located near the rear end of the adjustable width paver 200. In embodiments, the connection point 118 or the plurality of connection points 118 are mounted to the frame 102 using one or more mounting plates. The mounting plates may include/incorporate weight or stress sensors. The weight or stress sensors used to indicate the amount of pressure or weight applied to the materials conveyor 108 during loading, charging, or communicating the paving materials to the adjustable width paver 106.

Figure 4:
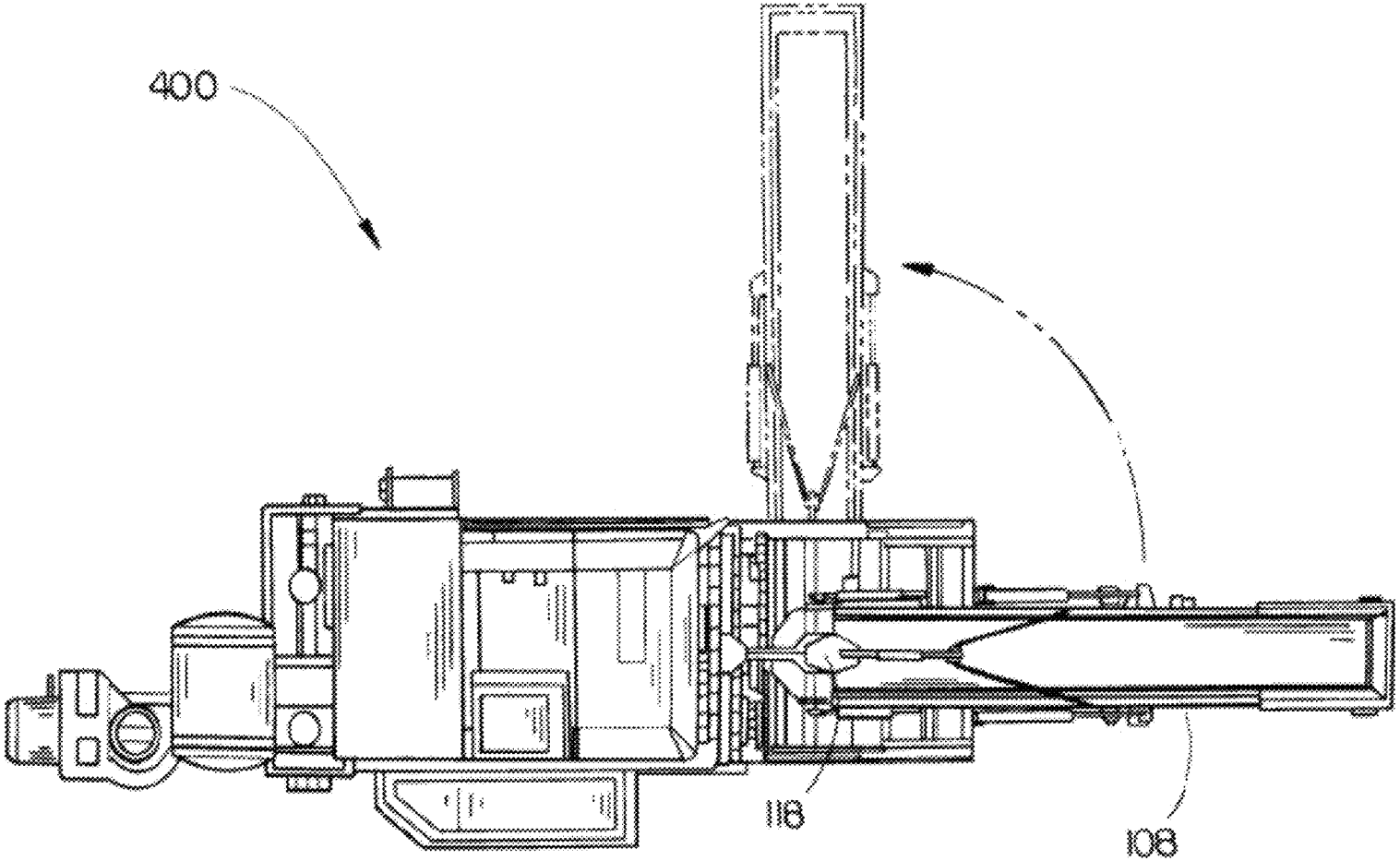
FIG. 4 shows an adjustable width paver according to embodiments having a 90° pivoting conveyor.

Referring to FIG. 4, an adjustable width paving machine 400 having a connection point 118 and a 180° pivoting/rotating moveable and controllable conveyor 108 is illustrated. The connection point 118 is operably connected to a conveyor drive (not shown) to allow the moveable and controllable conveyor to rotate or pivot 90° from a left side of the prime mover, or 90° from a right side of the prime mover (not shown in figure). This range of movement is generally within the range of from 1° to 90°. This range of movement including from 1° to 90° from either the left or the right side. In embodiments, the rotation or pivoting into and out of different positions is achieved by a linear piston-and-cylinder assembly, the piston-and-cylinder assembly operably connected to a conveyor drive. The linear piston-and-cylinder assembly may be in communication with a collar assembly. The linear force of the piston-and-cylinder assembly being transformed into rotational force with one or more coupling blocks pivotally affixed to the collar assembly. In further embodiments, the rotation or pivoting is achieved by one or more gears, belts, or chains operably connected between the conveyor drive and the materials conveyor 108.

In yet further embodiments, the rotation or pivoting is achieved by pivoting/rotating a vertically telescopic housing structure connected to the materials conveyor 108 at a connection point 118. The housing structure having one or more notches or keyholes. A collar assembly surrounds the housing structure. The collar assembly having one or more protruding lobes that fit into the one or more notches or keyholes in the housing structure. Linear force may then be transformed into rotational force by one or more coupling blocks pivotally affixed to the collar assembly, which rotates the one or more protruding lobes, which in return rotates the housing structure. The housing structure housing a pivot-and-cylinder assembly assembled at a vertical axis within the housing structure. The pivot-and-cylinder assembly at a vertical axis is within the housing structure and is used to elevate or raise the materials conveyor 108.

Referring again to FIG. 2, the moveable controllable materials conveyor 108 and connection point 118 are further configured with the conveyor drive to allow elevating or raising of the conveyor 108 while it is fully extended (not folded) in order to avoid smaller obstacles such as fire hydrants. The extent of the elevating or raising may vary, but generally is within the range of 2.54 cm (1 in.) to 30.48 cm (12 in.). This range including from 2.54 cm (1 in.) to 30.48 centimeters (12 inches). In embodiments the elevating or raising to different positions is achieved by a piston-and-cylinder assembly. The piston-and-cylinder assembly is operably connected to a conveyor drive, and is assembled to actuate elevation or raising along a vertical axis near the connection point(s) 118. In embodiments, the piston-and-cylinder assembly for elevating is further assembled through the collar assembly and within a housing structure.

Referring again to FIG. 2, the moveable controllable materials conveyor 108 and connection point 118 are further configured with the conveyor drive to allow tilting of the conveyor 108 (e.g., azimuthally) while it is fully extended (not folded) in order to avoid smaller obstacles such as fire hydrants. The extent of the tilting may vary, but generally is within the range of 1 to about 45 degrees. This range including from 1-45 degrees. In further embodiments, the extent of the tilting is from 1 to about 30 degrees. In embodiments, the tilting movement is achieved by one or more piston-and-cylinder hydraulic tilting assembly 132 operably connected to connection point(s) 118, the conveyor drive, and the longitudinal beam members of the structural framework 114, such that when power is supplied to the piston-and-cylinder tilting assembly 132 the structural framework 114 tilts to various positions (e.g., azimuthally).

Referring to FIG. 2, the structural framework assembly 114 of the conveyor 108 is of a generally rectangular shape, formed by at least two longitudinally extended, spaced beam members. The longitudinally extended, spaced beam members being interconnected by transverse beam members, such that from a frontal view, the longitudinal beam members and transverse beam members generally form an "I", "U", or inverted "U" shape. In embodiments a third longitudinal beam member is included to provide additional support. One or more of the transverse beam members are operably connected to a conveyor belt drive, enabling the movement of a conveyor belt or other paving material conveying means (e.g., flexible meshwork or segmented conveying means). In embodiments, the transverse beam members generally slope downward and inward so the materials conveyor 108 forms a "V" shape. The "V" shape helping to retain paving material on the materials conveyor 108 during communication or delivery of paving materials to the adjustable width paver 106. In embodiments, the longitudinal and transverse beam members are of a composition sufficient to provide support while paving materials are added to the materials conveyor 108. For example, the composition may include a reinforced steel or metal, carbon steel, steel alloy, or other type of alloy that is sufficiently strong to support the loading of paving materials onto and off of materials conveyor 108.

Referring again to FIG. 2, the structural framework assembly 114 of the conveyor 108 having two or more segments 204 and 206. The framework assembly 114 of the conveyor 108 also having a folding actuator means. The folding actuator means including but not limited to, an at least three-point connecting joint 208 hydraulically connected to the conveyor drive and the first segment 204 and the second segment 206. The folding actuator means configured so that when pressure or power is supplied to the folding actuator means, the second segment 206 folds towards the first segment 204 (e.g., azimuthally). The degree to which the second segment 206 is folded towards the first segment 204 may vary, but is generally within the range of 1 to 170 degrees. This folding range including from 1 degree to 170 degrees. Referring to FIG. 3, an adjustable width paver 300 having the conveyor 108 in a fully folded or nearly fully folded position, is illustrated.

The advantages of the various aspects of this disclosure will be apparent to one of ordinary skill in the art. Nevertheless, a specific advantage can be seen in FIGS. 5-6. Referring to FIG. 5, an adjustable width paver 500 is conceptualized during a state of operation. The state of operation as illustrated includes utilizing the pressure compensated side plates 502 and 504 of the adjustable width paver 106 to pave a flat slab sidewalk or trail. When an obstacle, such as a tree or a light pole, is near the path to be paved, an operator standing on the folding operator walkway 506 utilizes the operator control 112 to fold the conveyor 108 and move the conveyor 108 around the obstacle.

Figure 6:
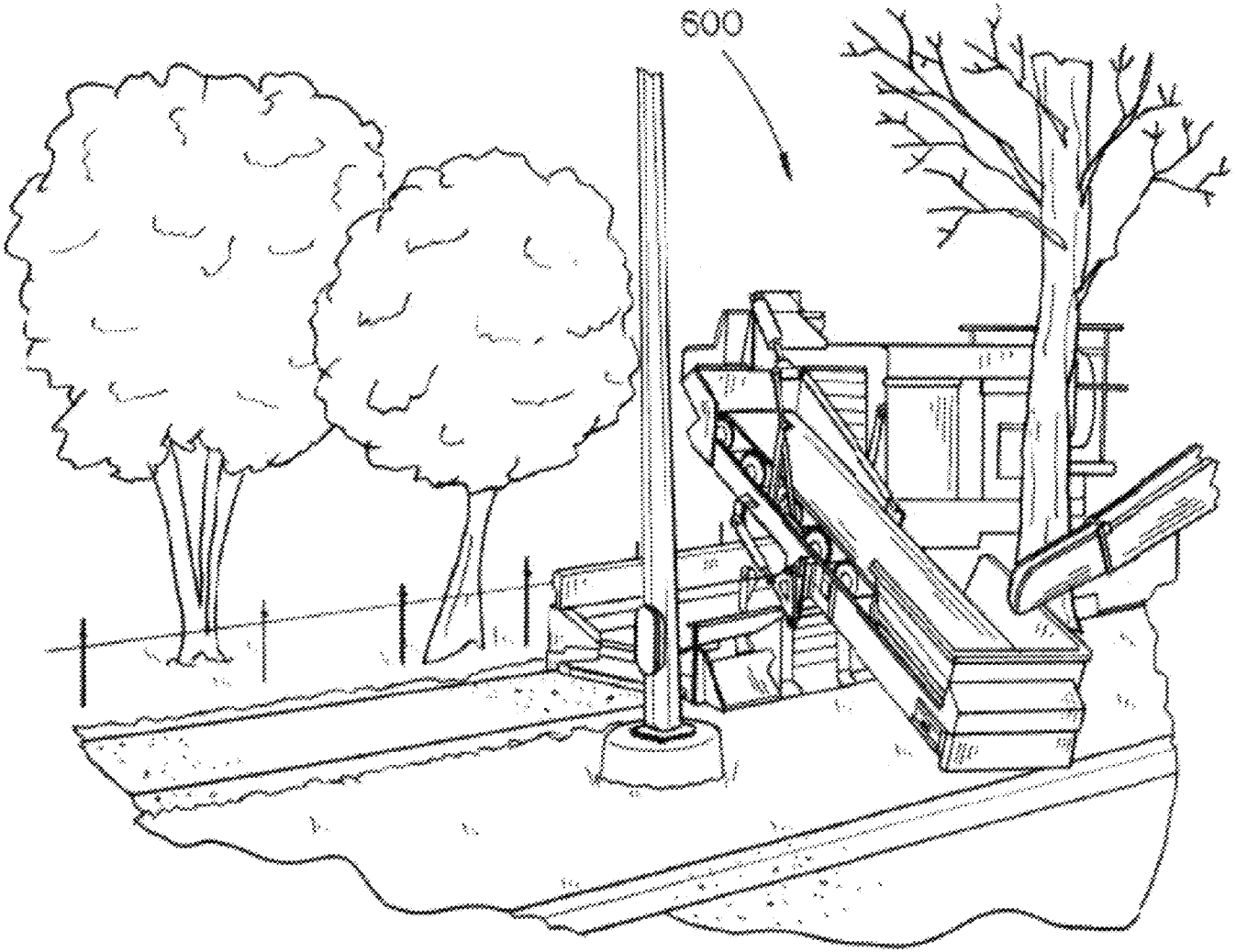
FIG. 6 shows an adjustable width paver according to embodiments during operation and ready to load additional paving materials after being unfolded.

Referring to FIG. 6, an adjustable width paving machine 600 is conceptualized during a state of operation after the conveyor 108 has been moved to avoid one or more obstacles. Once the conveyor has been moved around the obstacle, the conveyor can be unfolded to continue to receive paving materials from a loading truck.

In order to achieve the states of operation as illustrated in FIG. 5 and FIG. 6, at least the discharge hopper 122, the materials conveyor 108, and the operator control 112 will have to be specifically configured to enable continuous paving while the conveyor 108 is folded and moved around obstacles. This can be done by communicatively coupling the discharge hopper 122 and the conveyor 108 to the operator control 112. The term "hopper" is not limiting, but can include any known containment means for containing or temporarily holding paving materials prior to paving. For example, any known containment means might include two or more smaller hoppers communicatively connected in a series to convey materials from the conveyor 108 to the adjustable width paver 106.

The materials conveyor 108 includes a receiving hopper 128 for receiving paving materials (e.g., cement or concrete) in a plastic state (see, FIG. 1). The receiving hopper 128 includes an opening for receiving material and an opening for discharging material. The openings defined by at least two walls that generally slope inwardly towards the materials conveyor 108. In embodiments, the receiving hopper is not limited to a particular geometrical configuration, for example, the receiving hopper may be generally conical, square, rectangular, triangular, or elliptical in shape.

The receiving hopper 128 also includes one or more ridgelines 130 formed in one or more of the walls (or over the portions of the surface), to help vary or control the speed at which the paving materials exit the receiving hopper 128. The geometrical shape of the ridgelines is not limiting, as it is noted that any generally protruding shape may achieve the rate-controlling function (i.e., the ridgelines may be replaced by raised arc or prism structures). In embodiments, the number and shape of the protruding structures are varied to achieve faster or slower rates of discharge.

In embodiments, the receiving hopper 128 may also utilize a ridgeline 130 (or other protruding structure or indicator) as a reference to indicate the level at which paving materials should be kept to ensure continuous communication of materials to the discharge hopper 122. In embodiments, it is the discharge hopper 122 having an indicator to indicate the level at which paving materials should be kept, and in further embodiments, both the receiving hopper 128 and discharge hopper 122 have indicators.

According to embodiments, the discharge hopper 122 is in communication with the adjustable width paver 106, each level of communication helping to ensure continuous paving of the adjustable width trail paver. In embodiments, the receiving hopper 128 also includes one or more vibrator to further ensure the constant, continuous communication of paving materials to the materials conveyor 108. In further embodiments, the receiving hopper 128 includes a screen, meshwork, or other dispersing means located along a bottom surface (or bottom plane) of the receiving hopper 128 to help the constant and even discharge of materials from the receiving hopper 128 to the materials conveyor 108.

In embodiments, the materials conveyor 108 and discharge hopper 122 operate at adjustable speeds. The adjustable speeds allow for more or less paving material to be received, conveyed, or discharged. In embodiments, the operator control 112 is configured with a sensor to sense an obstacle along the path to be paved. The operator control 112 in response to the sensor sensing the obstacle, sends a signal to one or more of the discharge hopper 122, receiving hopper, and the materials conveyor 108. The signal may include information such as the amount of paving material that will be required to continuously pave while the materials conveyor 108 is moved around the obstacle.

In response to the signal from the operator control 112, the materials conveyor 108 may increase its conveyor speed, while the discharge hopper's 122 speed remains constant. This will result in additional paving material being built up in the discharge hopper 122 to be utilized while the materials conveyor 108 is moved or controlled around the obstacle. The increase of speed by the materials conveyor 108, will also result in the receiving hopper 128 having less paving material therein. Thus, in these embodiments, the operator monitors the indicator ridgeline 130 and when paving material levels are below the ridgeline, the rate at which the charging truck adds paving material to the receiving hopper 128 is increased. In embodiments, in response to the signal from the operator control 112, one or more vibrator's speeds are increased or decreased (i.e., vibrators associated with the receiving hopper 128, the discharge hopper 122, or the adjustable width paver 106). In embodiments, the operator control 112 utilizes an obstacle database to determine positions of obstacles, rather than sensing the obstacle in the path to be paved. In further embodiments, both sensors and the obstacle database are utilized together.

In embodiments, rather than increasing the speed of the materials conveyor 108, the speed of the prime mover 104 and the discharge hopper 122 can be decreased while the materials conveyor 108 is moved around an obstacle. This will result in less material being discharged by discharge hopper 122, but still allows continuous paving while the materials conveyor 108 is moved around an obstacle.

In embodiments, rather than adjusting speeds to achieve continuous paving, while the materials conveyor 108 is moved or controlled, volumes are adjusted. For example, discharge hopper 122 may have an adjustable volume such that when an obstacle is sensed to be along the path to be paved, the discharge hopper 122 increases its volume capacity by hydraulically expanding one or more sides of the discharge hopper 122. The volume of paving material conveyed to the discharge hopper may also be increased prior to moving the materials conveyor 108, such that the discharge hopper 122 has sufficient paving material to continuously pave while the materials conveyor 108 is controlled or moved around the obstacle. In these embodiments, a signal is generated to the operator, the signal indicating that the volume of paving materials received needs to be increased, decreased, or is sufficient.

In embodiments, the ridgeline indicator 130 is replaced by some other indicating or sensing means, including but not limited to, a weight, loss-in-weight, or gravimetric loss-in-weight sensor/detector, wherein the weight, loss-in-weight, or gravimetric loss-in-weight sensor/detector is the receiving hopper indicator. In embodiments where the receiving hopper indicator is electronic (i.e., it is not the ridgeline indicator 130), the receiving hopper indicator is operably coupled to the operator control 112. In further embodiments, the ridgeline indicator 130 is used together or in conjunction with the electronic indicator or the weight, loss-in-weight, or gravimetric loss-in-weight (i.e., electronic) sensor/detector.

In embodiments, the discharge hopper 122 includes an opening (e.g., input) for receiving the paving materials and an opening for discharging the materials (e.g., output) to the adjustable width paver 106. The hopper 122 includes a discharging means, the discharging means including, but not limited to: a transverse (or lateral) axis discharge auger; a surface (e.g., bottom surface) of the hopper 122 that variably opens and closes to release more or less paving material; or, a vertical axis stirrer, working in conjunction with gravitational forces to discharge the paving material. The hopper 122 also includes one or more hopper detector. Additionally, the discharge hopper 122 is operably in communication with the adjustable width paver 106, and is connected to the prime mover 104 via the frame 102.

In embodiments, the discharge hopper 122 includes a dual auger discharge system. The dual auger discharge system is operably connected to operator control 112 to allow the dual auger's speeds to coincide with one another, or to be distinctly variable. In further embodiments, the discharge hopper 122 utilizes the speed(s) of the dual hopper system to determine or detect the amount of paving material contained within the discharge hopper 122.

The discharge hopper 122 is also operably in communication with the materials conveyor 108 to further enable feeding of the paving materials to the adjustable width paver 106. The one or more hopper detector are in communication with the operator control 112. In embodiments, the various operable communication connections between the discharge hopper 122, the conveyor 108, the one or more hopper detector, and the operator control 112 enable the hopper to receive enough material to enable continuous paving while the conveyor 108 is being moved or controlled around an obstacle.

In embodiments, the one or more hopper detector are configured to detect the amount of paving material received in the discharge hopper 122 from a loading truck. The operator control 112 includes one or more computer, one or more memory storage, and one or more processor operably connected to the control 112. The one or more computer for various computations including, but not limited to, computing the amount of paving material needed to continuously pave a given/computed distance based on one or more given/computed paving dimensions, the continuous paving being independent of the position of the conveyor 108. The one or more memory storage for various storage purposes including, but not limited to, storing the computed amount of paving material needed to cover the given/computed distance for the given/computed paving dimensions. The one or more processor for various processing purposes including, but not limited to, processing the computed amount of paving materials needed to continuously pave a given/computed distance based on one or more given/computed paving dimensions. The operator control 112 also includes a signal generator for generating one or more signal, and one or more communication means (e.g., display, speaker, etc.) for communicating the one or more signal to an operator at the operator control 112. The signal may include any signal known in the art that would communicate to the operator that the discharge hopper 122 contains enough paving material to pave a given/computed distance based on one or more given/computed dimensions (i.e., while the conveyor 108 is moved or controlled); or, the signal may communicate that the discharge hopper 122 needs more/less material in order to pave a given/computed distance based on given/computed dimension (i.e., while the conveyor 108 is moved or controlled).

For example, the signal is a timer, an LED, or an icon corresponding to and indicating the level of material remaining in the hopper or the time remaining to move the conveyor 108 before more paving material will be needed to ensure continuous paving. In some embodiments, the signal is a timer, an LED, or an icon corresponding to and indicating the time between a first and second filling interval or between a first and second paving interval. The difference between the first and second filling intervals or the first and second paving intervals being based on one or more amounts of paving material received, needed, or discharged for paving one or more dimensions of trail. For example, in embodiments, the trail paver fills its discharge hopper 122 (e.g., first filling interval) and does not fill again until a computed time that is prior to the time the discharge hopper will be empty or nearly empty such that continuous paving is achievable (i.e., computer must calculate how much material is needed to pave the dimensions being paved and factor in how much time it takes to refill so that paving is continuous over the entire paving dimensions, even during a filling interval). In some embodiments, the difference between the first and second filling intervals or the first and second paving intervals is based on distances paved, or distances to be paved. For example, the trail paver fills its hopper 122 and then paves for a certain amount of time or over a certain predetermined distance, but will not enter the second paving interval (i.e., pave a second predetermined distance) until after the hopper is filled a second time. In embodiments, because paving is continuous there is no time difference between a first paving interval and a second paving interval, the intervals being only separated by a second filling interval. Therefore, in embodiments the before-mentioned signal, timer, or LED indicates the timing of intervals or timing between intervals, how much distance may be covered based on how much paving material was received, how much paving material is needed to pave between intervals, how much paving material was discharged between intervals, or how much paving distance has been paved between intervals.

In embodiments, the before-mentioned signal, timer, or LED communicates to an operator when the second filling interval should take place in to ensure continuous paving. The time communicated for the second filling interval need not be a specific time, but may be a range, such that if the second filling interval is commenced at any point during that range then the paving by the trail paver will be continuous.

In embodiments, the detector of hopper 122 is a gravimetric loss-in-weight sensor. Thus, the detector senses the amount of paving materials received in the discharge hopper 122, and calculates the amount of material discharged based on the loss in weight. Such techniques are known in the art as contemplated in Patent App. No. US20040002789 A1, which is incorporated herein by reference in its entirety.

In further embodiments, the detector is a volumetric sensor, detecting the volume of paving material received. This type of detection may be achieved by volumetric sensors or volumetric discharge/receiving calculations based on paving material compositions and discharge/receiving rates. For example, cement slurry densities can range anywhere from about 840 kg/m$^3$ (7 lbm/gal) to about 2760 kg/m$^3$ (23 lbm/gal). Knowing the speed at which the material conveyor belt drive moves (variable up to 91.7 mpm or 301 fpm), and the amount of paving material held or discharged by the material conveyor at that speed (the belt width is approximately 50.8 cm, or 20 in.), operator control 112 can be configured to calculate the volume of paving materials received in discharge hopper 122.

In embodiments, the operator control does not use hopper detectors in the discharge hopper 122 to detect the paving material received and communicated to the adjustable width paver 106. Rather, in these embodiments, the operator control 112 is in communication with pressure, stress, or weight sensors incorporated in or mounted together with the mounting plates of the connection point (or points) 118. In these embodiments, the force exerted on the connection point(s) 118 from the weight of the received paving materials added onto the materials conveyor 108 is measured by the pressure, stress, or weight sensors. This measured exerted force can be used in calculating software embedded in operator control 112 to determine the amount of paving material received. For example, first the sensors are nulled or set at a base/zero setting before paving materials are loaded into receiving hopper 128. As paving materials are added into receiving hopper 128 the force exerted on connection point(s) 118 increases. This increase of force can be used in calculations to measure the amount of paving material received.

In embodiments, the pressure, stress, or weight sensors incorporated with connection point(s) 118 are used together or in conjunction with the hopper detector(s) in the discharge hopper 122. In these embodiments, the pressure, stress, or weight sensors of connection point(s) 118 can help ensure accuracy of the measured paving materials received, or they can act as safety devices, which help determine when the amount of paving material received into receiving hopper 128 or onto materials conveyor 108 exceeds a safety threshold (where "safety" can include structural or operational safety).

According to embodiments, the adjustable width trail paver operates in different modes of operation including, but not limited to, automatic, manual, and partially automatic modes. In embodiments in which the adjustable width trail paver is configured to automatically operate, a stringless guidance system is utilized. When using the stringless guidance system the path to be paved is predetermined. "Predetermined" includes predetermining and configuring the operator control 112 to control the adjustable width trail paver such that it automatically follows a paving path that accounts at least for: paving length, width, and height dimensions; grade and elevation dimensions; paving path curvatures; obstacles along or in the path to be paved, dimensions of those obstacles or average time required to move around, or move the material conveyor around, the obstacles; calculations for the amount of paving or base/subbase material needed for given dimensions (e.g., for the entire paved path, and amounts required when moving or controlling the material conveyor); calculations for amounts of paving material actually received or discharged; subgrade preparation, including trimming and base preparations; fuel and oil levels; re-fueling times; operation speeds, both desired and actual; conveyor drive speeds; material conveyor belt drive speeds; discharge hopper speeds; spreader auger speeds; finished paving dimensions (smoothness, grade, etc.); bar insertion dimensions, including separation between bar insertions and depth of insertions; embedded software and databases (e.g., calculating software or an obstacle database, stored in a memory storage, the obstacle database containing position information regarding the position of various obstacles); locations of the adjustable width paver in relation to elevations, slopes, grades, reference points, or obstacles; gridline surveys; steering and steering commands; vibrator speeds; trimming speeds; trimming conveyor belt drive speeds; temperature gauges; emergency stop commands; lighting (i.e., for night time operation); weather indicators (i.e., whether or not it is raining/snowing); diagnostics; or other paving factors or variables known in the art.

In embodiments, the operator control 112 generates one or more signal for an operator monitoring the progress and operation of the adjustable width paver. The one or more signals include, but are not limited to: actual paving dimensions; grade and finished grade dimensions; operation speeds; component speeds (e.g., paving material speed, discharge hopper speed, spreader auger speed; etc.); signals indicating or alerting that an obstacle is, or should be approaching; and other signals including "move said conveyor into a loading position" and "move said conveyor into an obstacle clearance position." The signals "move said conveyor into a loading position" and "move said conveyor into an obstacle clearance position" may be generated or displayed in an automatic, manual, or partially-automatic operation mode. The difference between the modes lying in at least the degree at which the operator is involved. For example, in an automatic mode, the operator is involved in configuring embedded software, assembly, starting the operation, monitoring, providing fuel, providing paving and subbase materials, and almost nothing else. In a partially-automatic mode, the adjustable width trail paver accomplishes the majority of the tasks (e.g., paving, subgrade preparations, steering, detecting amount of materials received, detecting obstacles, etc.) automatically, while leaving tasks subject to variance to the operator (e.g., moving the paving materials conveyor around an obstacle, the obstacle subject to variance because it is a tree and it is a windy day or the obstacle is a car that was not parked along the path when the path to be paved was measured or "predetermined").

In a partially-automatic mode when signals "move said conveyor into a loading position" and "move said conveyor into an obstacle clearance position" are generated, the operator may switch the operator control 112 to a manual operating state while the operator moves the paving materials conveyor 108 around the obstacle and back into a loading/charging position. Although only the materials conveyor 108 has been specifically illustrated as manually operable in the partially-automatic mode, in embodiments, other components (e.g., trimmer 202 or base mold 110) also are manually operable in the partially-automatic mode. In a manual mode, the operator may choose or set the degree of involvement at which the operator would like to be involved. By varying the degree of involvement, the operator may manually adjust factors or settings of the adjustable width trail paver, including, but not limited to: steering (including adjustments based on stringline positions); operating speed; paving dimensions; vibrator and auger speeds; and subgrade preparations.

In embodiments, the adjustable width trail paver comprises a frame, a prime mover, a moveable and controllable conveyor, an adjustable width paver, and a coordinated turn module. The coordinated turn module (discussed in greater detail below) allows the paving machine to pivot at the paving former and to controllably increase its radius of curvature as compared to a paving machine with a non-pivoting paving former.

In embodiments, the coordinated turn module 900 comprises a pivoting connection member 1002, for pivotally connecting said paving former to said prime mover; a steering drive, for coordinating or steering the pivoting of said paving former; a detector, for detecting one or more angles at which the paving former is pivoted; and one or more stabilizing member for maintaining the paving former at least at an angle parallel with the surface being paved. While many pavers locate the paving former on the undercarriage of the prime mover, the rear location of the adjustable width trail paver's paving former allows for greater paving control, additional paving components attachable to the front of the prime mover, and minimum to zero clearance paving. Additionally, having a pivoting connection member that pivotally connects the paving former to the prime mover allows for tighter turns while paving, which is key when paving trails in neighborhoods.

In embodiments, the one or more stabilizing members 1004 and 1006 help the paving former maintain a paving plane substantially parallel to the surface being paved. In embodiments, the one or more stabilizing members are two parallel stabilizers that allow pivoting from side to side, while maintaining rigidity in a plane parallel to the surface being paved. In further embodiments, the two parallel stabilizers are at least partially telescopically expandable and retractable. In embodiments, the one or more stabilizing members 1004 and 1006 include two parallel mold stabilizers, capable of maintaining a paving mold parallel to the surface being paved.

In embodiments, the detector of the coordinated turn module (not shown) is operably connected to a computer having at least a processor and memory. The detector is configured to allow the computer to monitor turns and to communicate turning angles to the computer. Thus, the computer may utilize a turning algorithm to calculate predetermined turning radii or turning angles and compare the predetermined turning radii or turning angles to the communicated turning angles. The computer may then send signals to the steering drive 1010, the signals corresponding to at least one of: increase, decrease, or maintain turning power.

In further embodiments, the coordinated turn module 900 also includes: a steering drive, for coordinating or steering the pivoting of said adjustable width paver; and, a mounting assembly having a width substantially equal to said frame and having one or more parallel stabilizing member for maintaining the adjustable width paver at least at an angle parallel with a surface being paved and one or more vertical stabilizing member for maintaining a vertical center axis of the adjustable width paver substantially orthogonal to the surface being paved, said mounting assembly attached to the rear of said frame.

In embodiments, the mounting assembly (including 902 and 904) is attached to at least a portion of the frame of the prime mover that is hydraulically expandable. When the frame is hydraulically expanded, the mounting assembly is also expanded and paving pan inserts (not shown) are positioned to accommodate paving with the now wider paving former, paving pan, or paving mold. In embodiments, the mounting assembly also includes a longitudinal support structure 908, which is attached in a partially longitudinal manner such that the front of the structure is attached to the front of the prime mover and the rear of the structure is pivotally connected to the paving former (or adjustable width paver). In embodiments, the longitudinal support structure prevents the paving former from lifting as the frictional force of forming the paving materials is transferred to the paving former.

Further embodiments of the present disclosure are directed to a paving machine comprising a frame, a prime mover, a moveable and controllable conveyor, an adjustable width paver, a coordinated turn module, and one or more additional paving components. The one or more additional paving components are in communication with the operator control 112 and may be interchangeable, detached, or fixed.

For example, in one embodiment the one or more additional paving components include a string-line sensor system. The string-line sensor system comprising one or more sensors or one or more detectors known in the art. The sensors and detectors are configured to communicate with the operator control 112 to sense or detect distances from a stringline 508 (FIG. 5) and communicate those distances to the operator control 112. The operator control 112 is configured to allow automatic or manual adjustments of positioning based on the distances sensed or detected.

Figure 7:
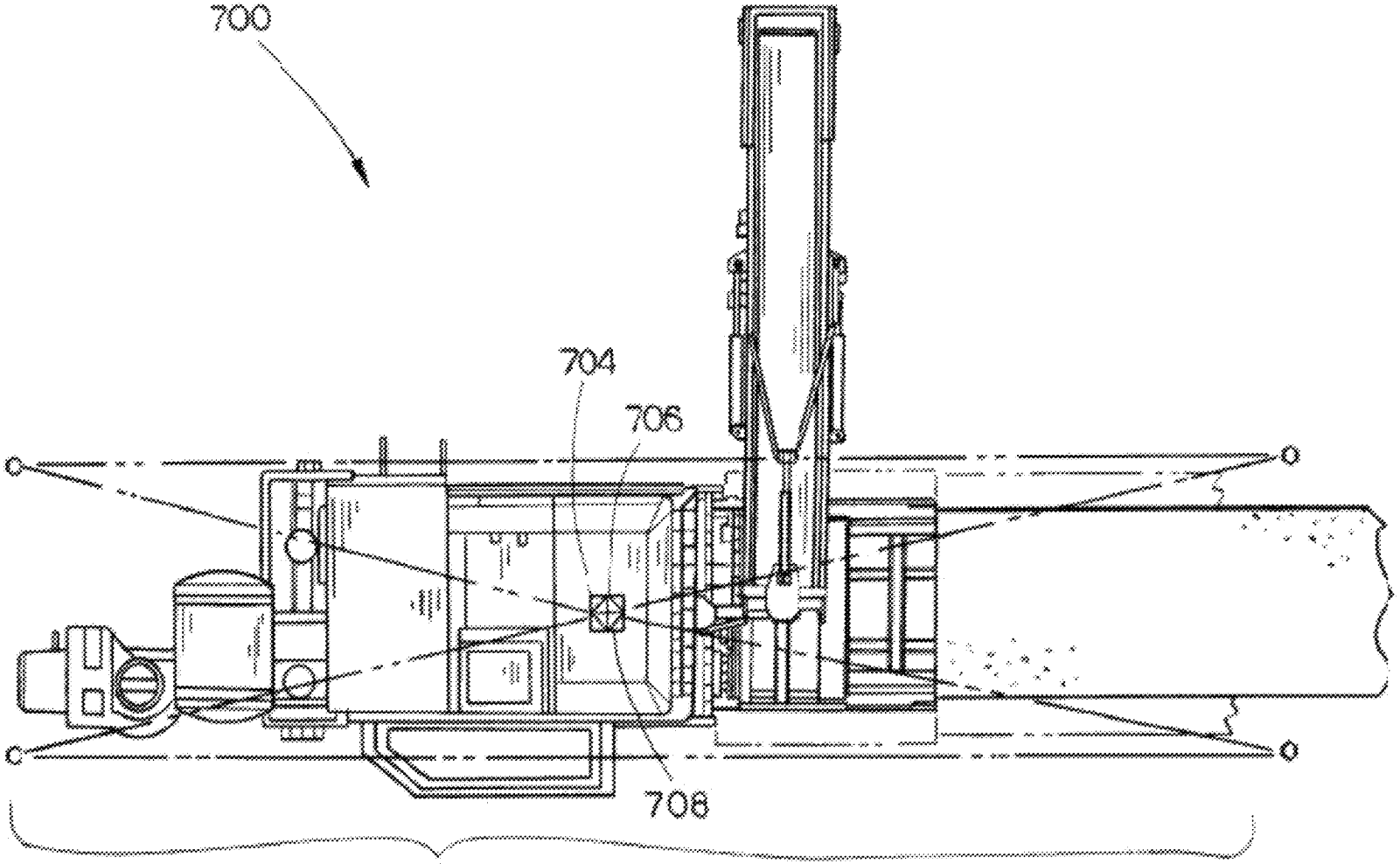
FIG. 7 shows an adjustable width paver according to embodiments having a stringless guidance system incorporated with the adjustable width paver.

In embodiments, the additional paving components include one or more prism, one or more sensor, and corresponding software embedded in the operator control 112, each operationally working together to form a stringless guidance system as illustrated in FIG. 7. The stringless guidance system helps enable the adjustable width paving machine 700 to follow a predetermined course.

Referring to FIG. 7, an adjustable width paving machine 700 having a stringless guidance system 702 incorporated therewith is illustrated. The stringless guidance system 702 comprises one or more prism mounting poles 704 and one or more sensors 706 and 708. The one or more prism mounting poles 704 are attached to the adjustable width paver 700. The prism poles 704 have one or more 360 degree prism attached to the top of each of the one or more prism poles, and are communicatively coupled with the operator control 112. In embodiments, the prism poles 704 are located at various locations on the adjustable width paving machine 700, for example, on the front and rear corners of the paving machine 700.

In embodiments, the prism poles 704, the 360 degree prisms, and the sensors 706 and 708 working together are called total stations. In further embodiments, at least one total station mounted in the center of the machine is used. In yet further embodiments, at least two total stations are used to help ensure parallel travel (i.e., front direction of travel is parallel with back direction of travel).

The one or more prism poles 704 locate the elevation of the rear or the front of the machine. In embodiments, the prism poles 704 also have one or more dual axis slope sensor 706 and 708, which measures cross slope (side to side) and long slope (front to rear). The one or more dual axis slope sensor 706 and 708 are mounted to each of the one or more prism poles 704 and communicatively coupled with the operator control 112. In further embodiments, the one or more prisms of the prism poles 704 locate the elevation of the rear of the adjustable width paver 700, while the dual axis sensors 706 and 708 locate the front elevation. In embodiments, the communicative coupling of the stringless guidance system is a CAN-Bus system or network.

Once the adjustable width paver 700 is assembled with its various components, including the stringless guidance system, the stringless guidance system is calibrated or configured to determine at least measurements, dimensions and locations necessary for the paving. Software embedded in the one or more memory storage of the operator control 112 may utilize these measurements, dimensions, and locations to control or move the adjustable width paver, and its various components, and to pave the path to be paved. In embodiments, the embedded software may be further configured such that the stringless guidance system sends signals to the software, which signals may be interpreted by the software to be obstacles or approaching obstacles. In further embodiments, the embedded software includes an obstacles database, where obstacles' positions in relation to the path to be paved are stored such that the software can access this information during automatic paving modes and move the materials conveyor 108 at the appropriate times or positions.

In embodiments, the additional paving components include a smoothness indicator 510 and corresponding software embedded in the operator control 112. The smoothness indicator 510 is used for measuring a profile of a paved surface, such as a surface paved with concrete or asphalt; a base course including base courses of cement treated base (CTB), lean concrete base, crushed stone, and crushed slag; a subbase, such as a subbase of subgrade soil or aggregate; a subgrade upon which a subbase, a base, a base course, or pavement is constructed; other graded surfaces including sand, rock, and gravel; or surfaces which have not been graded. The smoothness indicator 510 is also used to measure profiles for surfaces which have not cured, such as freshly paved concrete still in a plastic state.

The smoothness indicator 510 may include one or more sensor. Each of the one or more sensor includes a pair of non-contact elevation distance sensors, disposed at a known distance from one another for measuring distances to the surface, and a slope sensor for measuring angles of incidence of the sensors relative to a horizontal plane. In embodiments, the smoothness indicator generates an elevation profile by periodically calculating elevations along the surface using the measured distances and the angles of incidence.

In embodiments, the additional paving components include a bar inserter (not shown). In further embodiments, the bar inserter is a hydraulic bar inserter. The bar inserter having two or more vibrating bar insertion forks to automatically and periodically insert one or more bars into the paving material while in a plastic state. In yet further embodiments, the bar inserter is communicatively coupled to the operator control 112 to enable an operator to control or determine the depth of and width between bar insertions. A paving pan, paver, mold, or slipform mold used in conjunction with the hydraulic bar inserter has a space (e.g., in the pan) for holding dowel bars in the ready before they are inserted into the concrete. The dowel bar inserter is generally above each of the bars to insert them into the concrete using a downward application of pressure.

In embodiments, the additional paving components include an oscillating straight edge and paving/smoothing pan. In further embodiments, the straight edge and paving/smoothing pan are located behind the bar inserter to repair scarring that may occur in the paving material due to the bar insertions.

In embodiments, the additional paving components include at least one additional vibrator for evenly receiving, discharging, or compacting the paving materials. The at least one additional vibrator are, for example, hydraulically powered, motor-in-head, variable-speed, and independently controlled vibrators.

According to embodiments, the legs or support structures, including leg 126 comprise smart steer cylinders. The smart steer cylinders are operably integrated with or connected to a trainable All Track steering system interchangeable with rubber tires. The smart steer cylinders reduce the number of moving parts. For example, in embodiments the smart steer cylinders do not require sprocket, chain, or potentiometer. The smart steer cylinders are communicatively coupled to operator control 112 so that the operator can "train" or teach the smart cylinder to set a desired degree or leg rotation so the legs and tracks do not strike obstacles along or near the path to be paved. This helps enable the zero-clearance or minimum clearance aspect of the present disclosure.

In embodiments, the All Track steering system includes a front track 126 integral with a front side of the frame 102, and also includes a rear side of the frame 102 being supported by a pair of generally parallel displaced and opposed rear track drive assemblies 304 (FIG. 3). The rear track drive assemblies 304 supporting each of the first and second sides (i.e., right and left sides) of the frame 102 and prime mover 104.

As used herein, "All Track" steering meaning that each of the two or more tracks, and in embodiments, at least three tracks, work together simultaneously to steer the adjustable width trail paver. All Track steer further comprising a Stringline Steer Mode. This mode is selected when steering is to be controlled by the steering sensors. With the machine on line and in automatic steer, the operator walks the machine in reverse to the existing sidewalk, utilizing the Reverse Steer feature. Then, flipping the switch to forward steer, the operator starts to pave (i.e., with a slipform mold or utilizing the pressure compensated side plates in the form of a paving pan).

All Track steer further comprising Coordinated Steer (for minimum turning radius). When the steer select switch is in the Coordinated Steer. In this mode, the steering control dial will control the turning of the tracks. When the dial is in the center position, the tracks will be straight ahead. If the dial is turned left or right from the center position, the leading track will turn in the corresponding direction and the trailing track will turn in the opposite direction. All Track steer further comprising Crab Steer. This mode allows the machine to walk sideways for ease in putting the machine on line. When the steer select switch is in the Crab Steer position, the steering control dial will control the turning of the tracks. If the dial is turned left or right from the center position, all tracks will turn in the corresponding direction to walk the machine sideways. The All Track steer further comprising Front Steer. In this mode, when the steer select switch is in the Front Steer position and the steering control dial is turned left or right from the center position, the front track will turn in the corresponding direction and the rear tracks will remain straight. In one or more of the steering modes (e.g., Front Steer) a front track drive assembly of the All Track steering system is steerable at least ninety degrees (90°) in either direction from a center axis. In one or more of the steering modes one or more of the rear track drive assemblies are steerable at fifteen degrees (15°) in either direction from a center axis. In further embodiments, the tracks of the All Track steering system are replaced by rubber tires.

In further embodiments, the additional paving components include, but are not limited to, a high or low pressure water system, an interchangeable auger system, and an interchangeable All Track Steering system (interchangeable with rubber tires that reach speeds of up to 41.5 mpm (136 fpm)). Whether or not a specific additional paving component is utilized to achieve the required paving is determinable based on numerous factors known to those skilled in the art.

In yet further embodiments, each of the additional paving components are communicatively coupled to the operator control 112. The communicative coupling is accomplished via communicative coupling means known in the art, for example, Bluetooth, wired, wireless, or CAN-Bus communication means.

Additionally, each of the various components of the adjustable width paver (including, but not limited to, embodiments 100, 200, 300, 400, 500, 600, and 700) are structurally configured to allow the adjustable width paver and each of its components to pass within about 5.08 cm (2 in.) of obstacles along or near the path to be paved. The structural configuration also helps enable the zero-clearance or minimum clearance aspect of the present disclosure.

Additionally, each of the various components of the adjustable width paver (including, but not limited to, embodiments 100, 200, 300, 400, 500, 600, and 700) are sized in appropriated dimensions to give the adjustable width paver a more compact bulk to maneuver around or near obstacles along a path to be paved, and to be more compact during different states of operation. For example, the prime mover is powered with a 59.7-74.6 KW (80-100 HP) diesel engine. Although larger sizes are available, the smaller size utilized in the adjustable width paver provides sufficient moving and drive power while remaining small enough to fit in gaps between obstacles less than 1.98 m (6.5 ft.) wide (i.e., when the folding operator walkway 506 is folded into a storage position) and gaps less than 2.75 m (9 ft.) (i.e., when the folding operator walkway 506 is unfolded in an operating position). Additionally, as noted in embodiments of this disclosure, many of the components of the adjustable width trail paver have internal hydrostatic systems/motors, the internal configuration further enabling the compact bulk for maneuverability and zero- to minimum-clearance. Additionally, the adjustable width paver 106 is sized such that it has a width substantially equal to said frame 102, when the adjustable width paver 106 is attached to said frame.

In embodiments, the components of the adjustable width paver are not only sized for maneuverability and zero- to minimum-clearance during operation, but also for storage or transportability. Additionally, components such as the folding operator walkway 506 and the conveyor 108 are foldable for storage or transportability (folding operator walkway 506 is shown to be on one side of the prime mover 104, however, this is merely illustrative as the walkway 506 is designed to be detachable and mountable at an operable position on either side of the prime mover 104, or of either side of the frame 102). In embodiments, the compact dimensions for transportation include width, height, and length dimensions of 1.92 m (6.3 ft.) wide, 2.93 m (9.6 ft.) high, and 8.69 m (28.5 ft.) long.

Further embodiments of the present disclosure are directed to a paving machine comprising a frame, a prime mover, a moveable and controllable conveyor, and a pivoting/pivotable or steerable adjustable width paver for adjusting or increasing the turning radius of, or the radius of curvature achieved by, the trail paver. In embodiments, the pivoting or steerable adjustable width paver being pivotable or steerable due to the coordinated turn module 900. The coordinated turn module 900 pivotally connects the adjustable width paver 106 to the frame 102 or to the prime mover 104. In embodiments, the adjustable width paver 106 and coordinated turn module 900 utilize paving molds of different dimensions to achieve different paving dimensions, the different paving dimensions including, but not limited to, different paving widths from one to four meters. In embodiments, the pivoting adjustable width paver 106 includes any paving former known in the art (e.g., slipform formers) (see, for example, steps 1308 and 1404 below).

Figure 9:
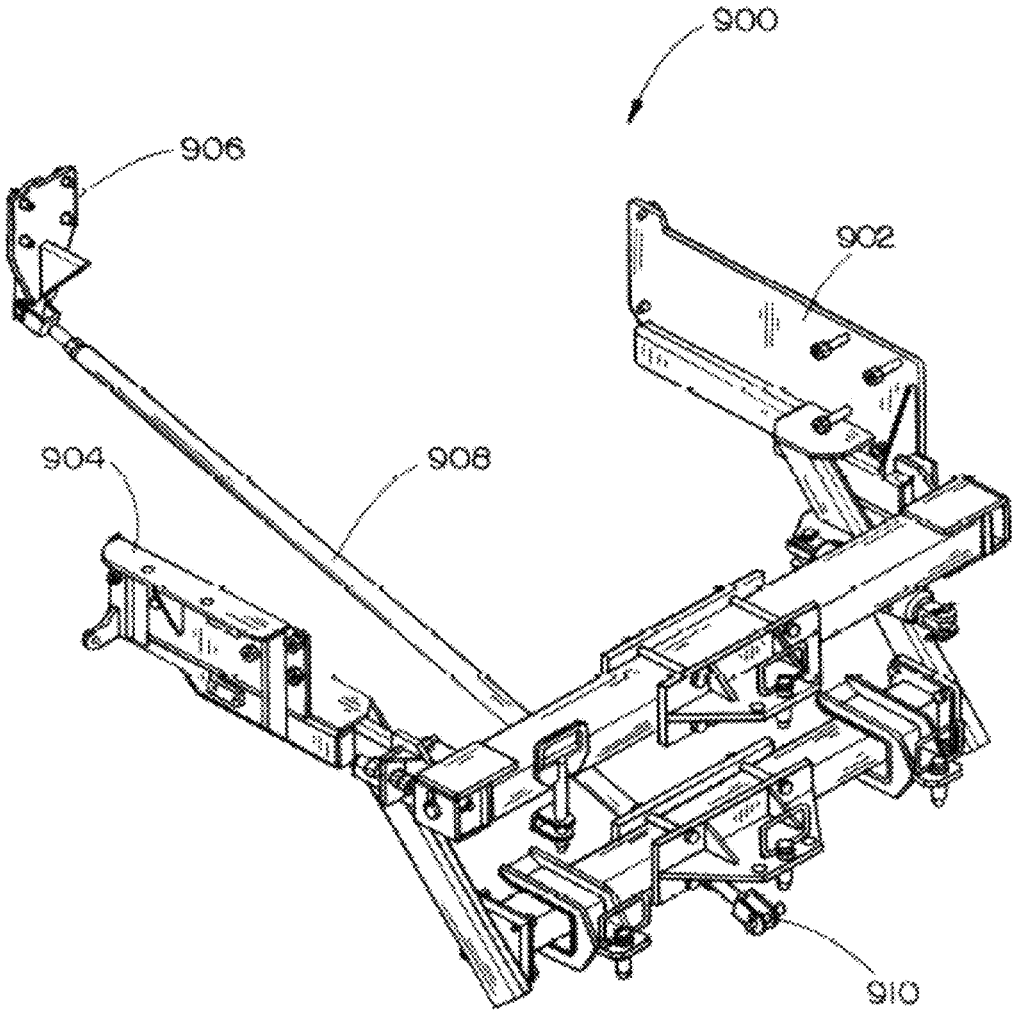
FIG. 9 shows a perspective view of a coordinated turn module for the adjustable width paver, the coordinated turn module being pivoting.

Referring now to FIG. 9, in embodiments, the coordinated turn module 900 includes at least two connection points, the at least two connection points including mounting plate 902 and mounting plate 904 (i.e., mounting assembly). Mounting plate 902 is connected to the right side of the prime mover 104. In further embodiments, mounting plate 902 is connected to (or in connection with) a portion of the frame 102, the portion of the frame 102 to which mounting plate 902 is connected is a portion of the hydraulically expandable frame 102. In embodiments, the hydraulically expandable frame 102 is a hydraulically telescopic frame. In embodiments where mounting plate 902 is connected to the hydraulically expandable frame 102, the width of the adjustable width paver 106 is adjusted as the frame 102 hydraulically expands laterally. Accordingly, the paving molds utilized are also laterally adjustable (i.e., expandable) and include paving mold or paving pan inserts to accommodate paving at the adjusted widths.

In embodiments, mounting plate 904 is connected to (or in connection with) the left side of the prime mover 104. In further embodiments, mounting plate 904 mounts to tapped pads or mounting plates on the frame 102 of the prime mover 104, the tapped pads being capable of mounting at least portions of the folding operator walkway 506.

In embodiments, the mounting assembly includes at least a third connection point. The at least a third connection point including mounting plate 906. In further embodiments, mounting plate 906 mounts to the front side of the prime mover 104. In yet further embodiments, mounting plate 906 mounts to the frame 102, which is incorporated with or connected to the front side of the prime mover 104.

In embodiments, mounting plate 906 connects the front side of the prime mover 104, or the front side of the frame 102 incorporated with the front side of the prime mover 104, to a cross tube of the discharge hopper 122. In embodiments, the cross tube is a cross bar. In further embodiments, the connection by mounting plate 906 to the discharge hopper 122 is facilitated by a turnbuckle assembly 908, wherein the turnbuckle assembly 908 has a first end and a second end. The first end being connected to mounting plate 906. The turnbuckle assembly is also long enough to extend the length of the prime mover 104 and extend just past the rear side of the prime mover 104 to connect to a pivoting point 910 generally located at the second end of the turnbuckle assembly. In embodiments, the second end of the turnbuckle assembly 908 is pivotally connected to a lower cross tube of the discharge hopper 122. In embodiments the pivotal connection is created by the second end of the turnbuckle assembly 908 being operably connected to a pivot lug (not shown) that is on the lower cross tube of the discharge hopper 122 (i.e., creating pivot point 910). The pivot lug is connected to the second end of the turnbuckle assembly 908, which allows the adjustable width paver to pivot. In embodiments, the pivot lug comprises a second dynamically pivoting connecting member (the first dynamically pivoting connecting member discussed below).

If configured and assembled correctly, the turnbuckle assembly 908 provides additional support for the discharge hopper 122 and prevents the adjustable width paver 106 from lifting during paving. In embodiments, the turnbuckle assembly 908 is adjusted (i.e., tightened or loosened) to provide more or less support to the discharge hopper 122, to provide more or less lift of the paver 106, and to slightly modify the angle of paving achieved by the paving mold of the adjustable width paver 106. In embodiments, the turnbuckle assembly 908 includes any means known in the art for providing additional support to the adjustable width paver 106, or for preventing the adjustable width paver 106 from lifting during operation. For example, the turnbuckle assembly 908 may be replaced by a longitudinal support rod, a telescopic (e.g., hydraulically) support rod, or a longitudinal support beam.

Figure 10:
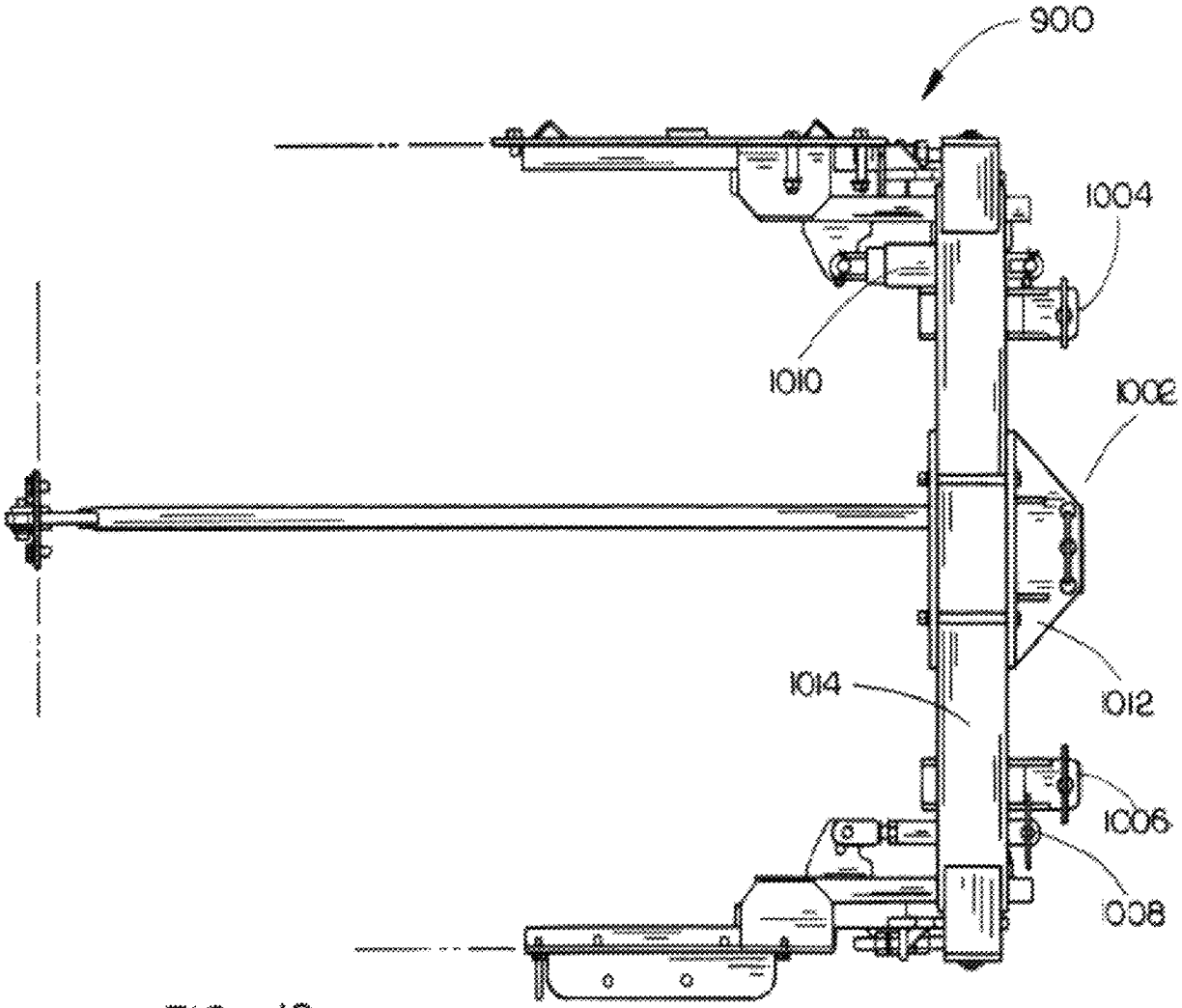
FIG. 10 shows a top perspective view of a coordinated turn module for the adjustable width paver.

Referring now to FIG. 10, in embodiments, the adjustable width paver 106 pivotingly connects to coordinated turn module 900 at one or more connection point 1002. In embodiments, the one or more connection point 1002 includes at least two connection brackets 1012; the at least two connection brackets 1012 including an upper mounting bracket and a lower mounting bracket. In embodiments at least one of the at least two connection brackets are used as a dynamically pivoting connection member. In further embodiments, the at least two connection brackets 1012 are used as the dynamically pivoting connection member. In further embodiments, the at least two connection brackets include quick-release connection pins, which quickly lock the adjustable width paver 106 into an operational position or quickly release the adjustable width paver from 106 the operational position (i.e., for putting the adjustable width paver 106 in a detached position).

Figure 11:
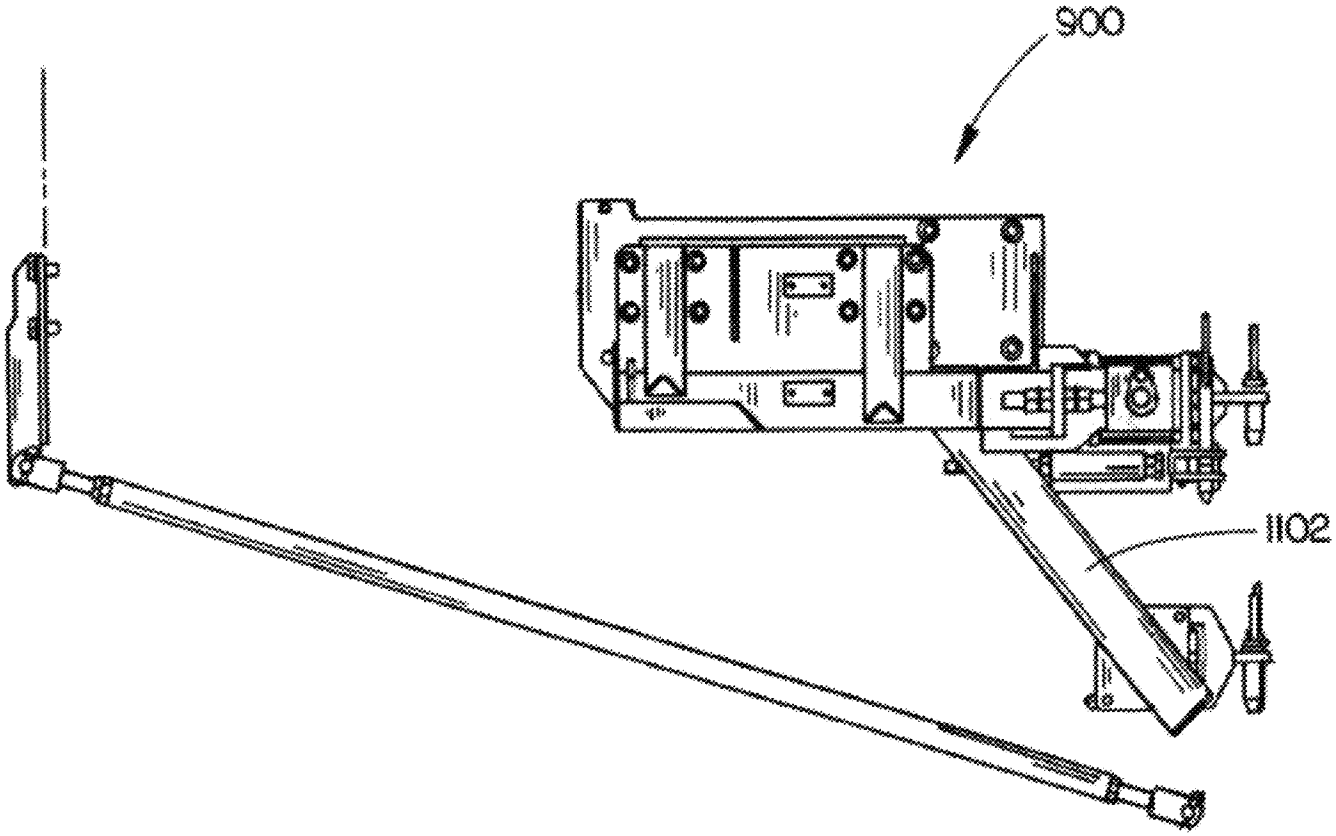
FIG. 11 shows a side perspective view of a coordinated turn module for the adjustable width paver.
Figure 12:
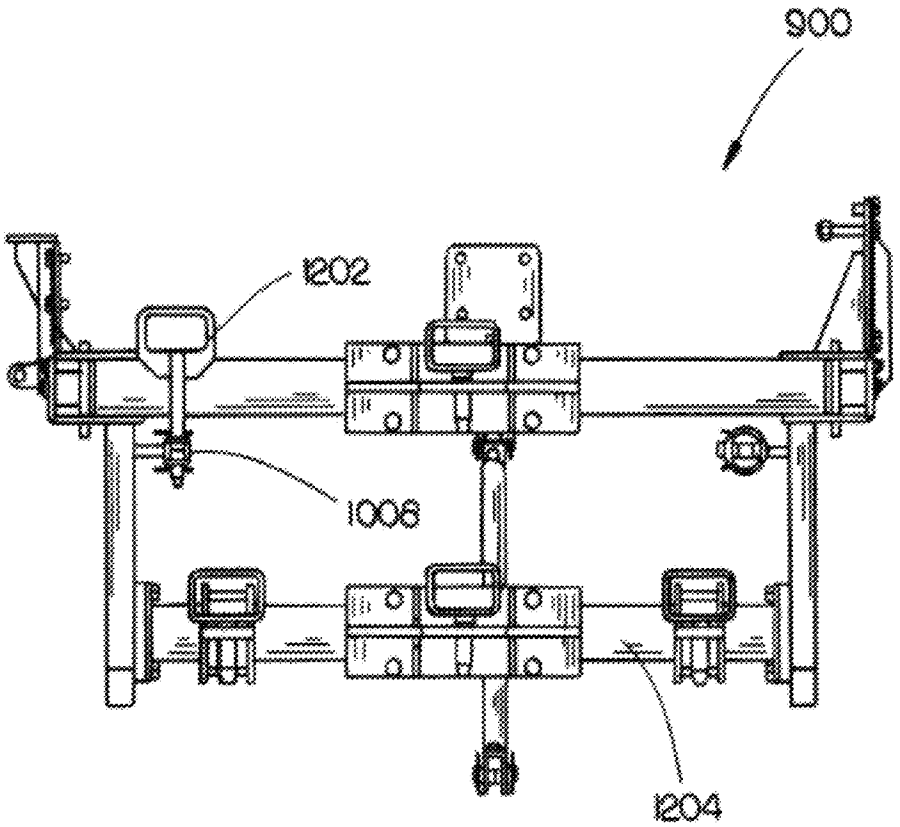
FIG. 12 shows a front perspective view of a coordinated turn module for the adjustable width paver.

In embodiments, the coordinated turn module 900 includes one or more transverse beam support structures 1014. In embodiments, there are at least two transverse beam support structures, an upper transverse beam support structure 1014 and a lower transverse beam support structure 1204 (see, FIG. 12). In embodiments, the at least two transverse beam support structures 1014 and 1204 are cross tubes, or cross beams. In embodiments, the upper mounting bracket of connection point 1002 is mounted to the upper transverse beam support structure 1014 and the lower mounting bracket is mounted to the lower transverse beam support structure 1204. In further embodiments, the coordinated turn module 900 includes one or more angled, side beam support structures 1102 (see, FIG. 11).

In embodiments, the coordinated turn module 900 includes one or more parallel stabilizers 1004 and 1006 to stabilize the adjustable width paver 106. In further embodiments, the stabilizers are paving mold/pan stabilizers. Stabilizers 1004 and 1006 include quick-release connection pins. In further embodiments, the quick-release connection pins may be automatically released or automatically locked in response to a signal from the operator control 112. In embodiments, the stabilizers 1004 and 1006 help ensure the adjustable width paver maintains a parallel position in relation to the beam support structure (e.g., cross tube) 1204 (see, FIG. 12).

In embodiments, the coordinated turn module 900 includes one or more locking mount 1008. When the one or more locking mount 1008 is locked, the adjustable width paver 106 is no longer pivotable. In embodiments, the one or more locking mount 1008 includes any locking means for locking the adjustable width paver 106 in place, to prevent pivoting. In further embodiments, the one or more locking mount 1008 includes a locking turnbuckle assembly and a quick-release pin; the turnbuckle assembly can be tightened or loosened, and it is used to lock the adjustable width paver 106 in one or more paving positions (e.g., a straight paving position when pivot is not required, or a specific angle of curvature desired for paving). The quick-release pin being released or locked by a handle 1202 (see, FIG. 12) that is operably connected to (or in connection with) the quick-release pin. In further embodiments, the quick-release pin may be automatically locked or released in response to a signal from the operator control 112.

In embodiments, the locking mount 1008 is unlocked (e.g., the quick-release pin is released) to allow the adjustable width paver 106 to pivot as the prime mover steers or turns according to the path to be paved. In further embodiments, the pivoting of the adjustable width paver 106 is controllable (i.e., making the pivoting of the adjustable width paver steerable) due to one or more hydraulic cylinder 1010 in communication with the coordinated turn module 900 and the adjustable width paver 106. Thus, as the prime mover 104 makes turns while paving, the amount or degree to which the adjustable width paver turns is controlled by the one or more hydraulic cylinder 1010, making the adjustable width paver 106 steerable. In embodiments, the hydraulic cylinder 1010 has adjustable or variable pressure, which allows the adjustable width paver to be dynamically steerable, meaning that the degree at which the trail paver turns is constantly changing during the turning. In embodiments, the hydraulic cylinder 1010 includes a pressure maintaining apparatus, meaning the pressure in the hydraulic cylinder 1010 is maintained constant, or is effectually locked/maintained at a certain pressure so that the degree of turning or the radius of curvature achieved by the trail paver remains constant during the turning. In further embodiments, the one or more hydraulic cylinder 1010 may be in communication with the operator control 112 such that at least the one or more hydraulic cylinder 1010 may be actuated, maintained, or at least the pressure of the one or more hydraulic cylinder 1010 may be adjusted in response to a signal from the operator control 112.

In embodiments, the coordinated turn module 900 allows the adjustable width paver 106, or the paving mold/pan of the adjustable width paver, to pivot up to 90° (90 degrees) relative to a longitudinal plane running down the center of the machine (i.e., the adjustable width trail paver). Thus, in embodiments, the adjustable width paver 106, or paving mold/pan of the adjustable width paver, pivots from one degree (1°) to forty-five degrees (45°) towards either side of the adjustable width trail paver. The pivoting increases the maneuverability and paving turning radius of the trail paver. Additionally, utilizing the one or more hydraulic cylinder 1010 of the coordinated turn module 900, at least the speed of pivoting and the pivoting radius of the adjustable width paver 106 are adjustable, which makes the now pivoting adjustable width paver 106 (or paving mold/pan) steerable. In further embodiments, one or more pulley systems, one or more gear assemblies, one or more belt and drive systems, or other methods known in the art for steering pivoting components are also contemplated in this disclosure to make the pivoting adjustable width paver 106 steerable.

The embodiments of the machines 100-700 illustrated in FIGS. 1-7 may be further configured as described herein. In addition, the machines 100-700 may be configured to perform any other step(s) of any of the method embodiment(s) described herein. The following method embodiments relate to adjustable width paving, zero clearance slipform paving, continuous paving, trimming, molding and compacting subgrade material, and moveable and controllable access to paving materials from loading trucks. It is generally recognized that machines 100-700 are suitable for implementing the paving, trimming, molding, compacting, and controllable access steps of the following embodiments. It is noted, however, the methods described below are not limited to the architecture of 100-700.

Figure 8:
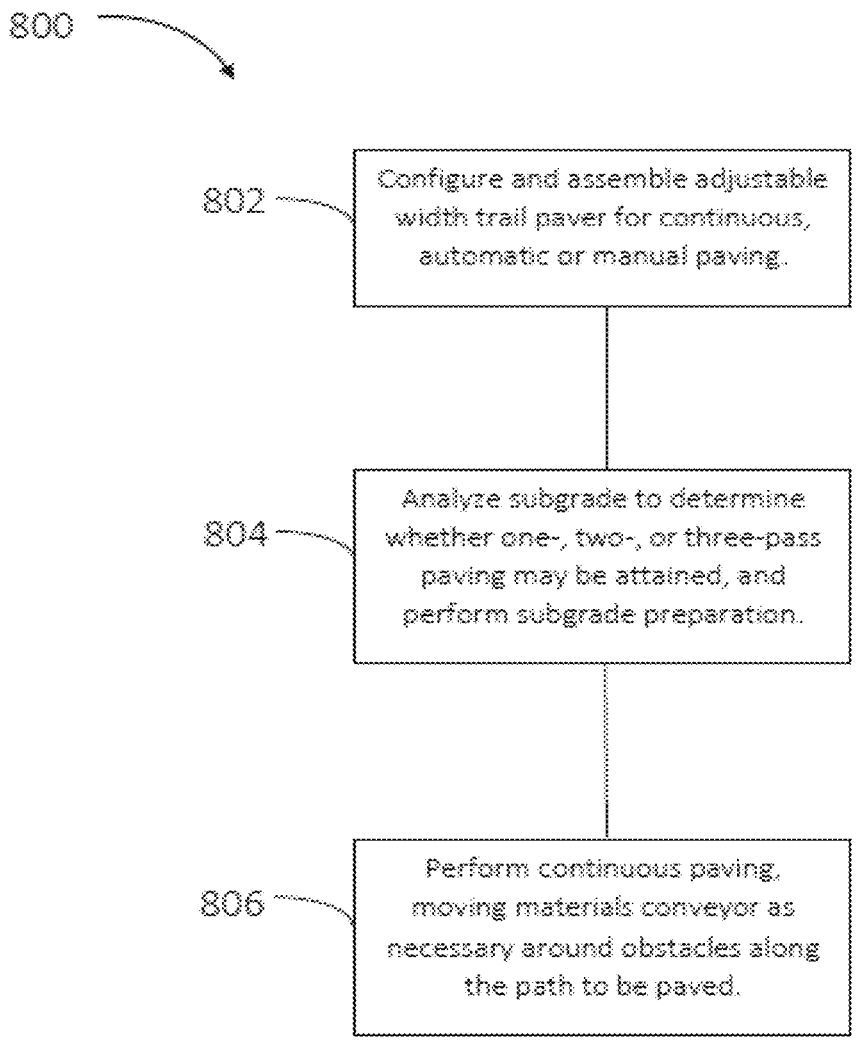
FIG. 8 shows a flow diagram according to embodiments depicting a method for continuous, zero- to minimum-clearance paving.
Figure 13:
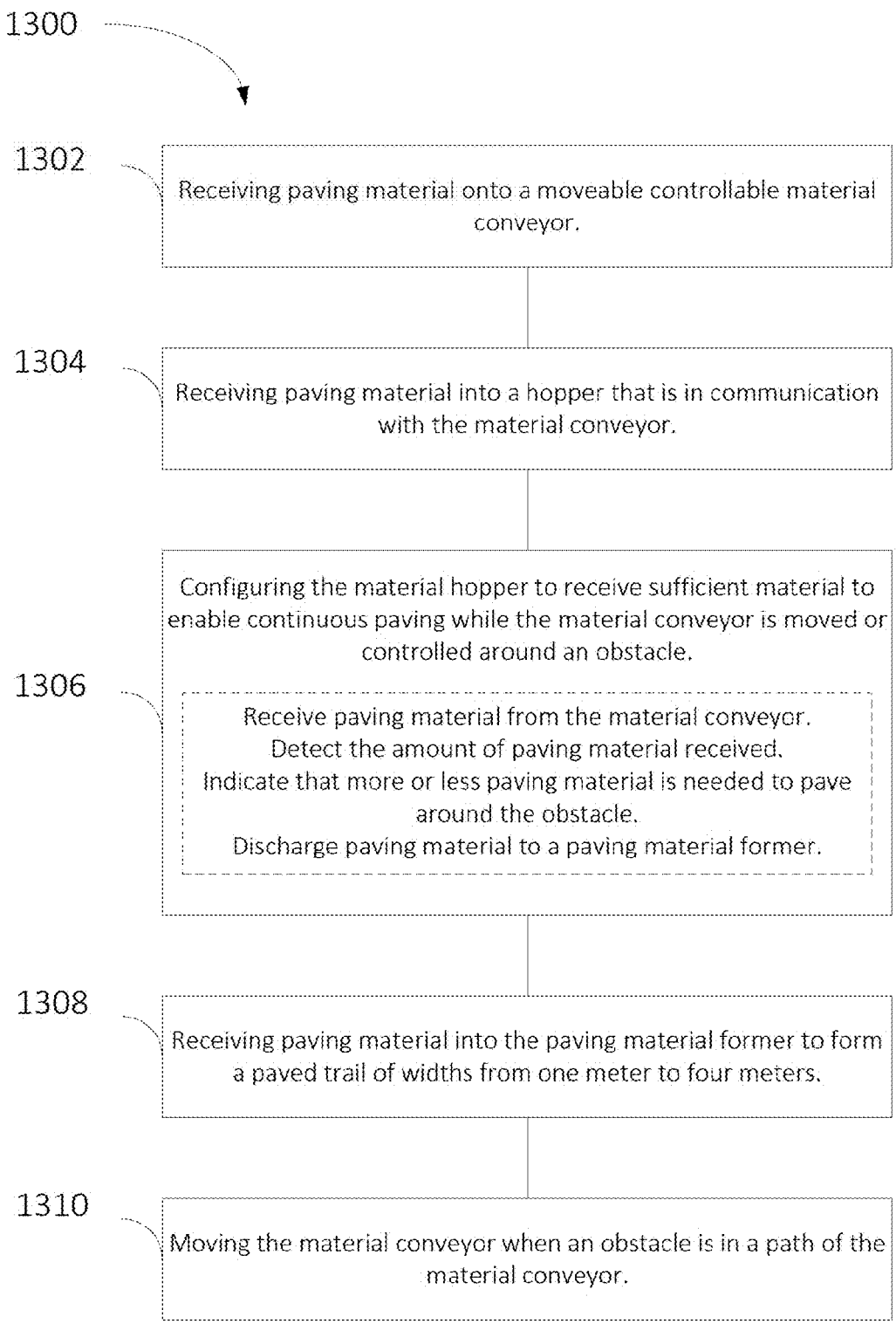
FIG. 13 shows a flow diagram according to embodiments depicting a method for paving.
Figure 14:
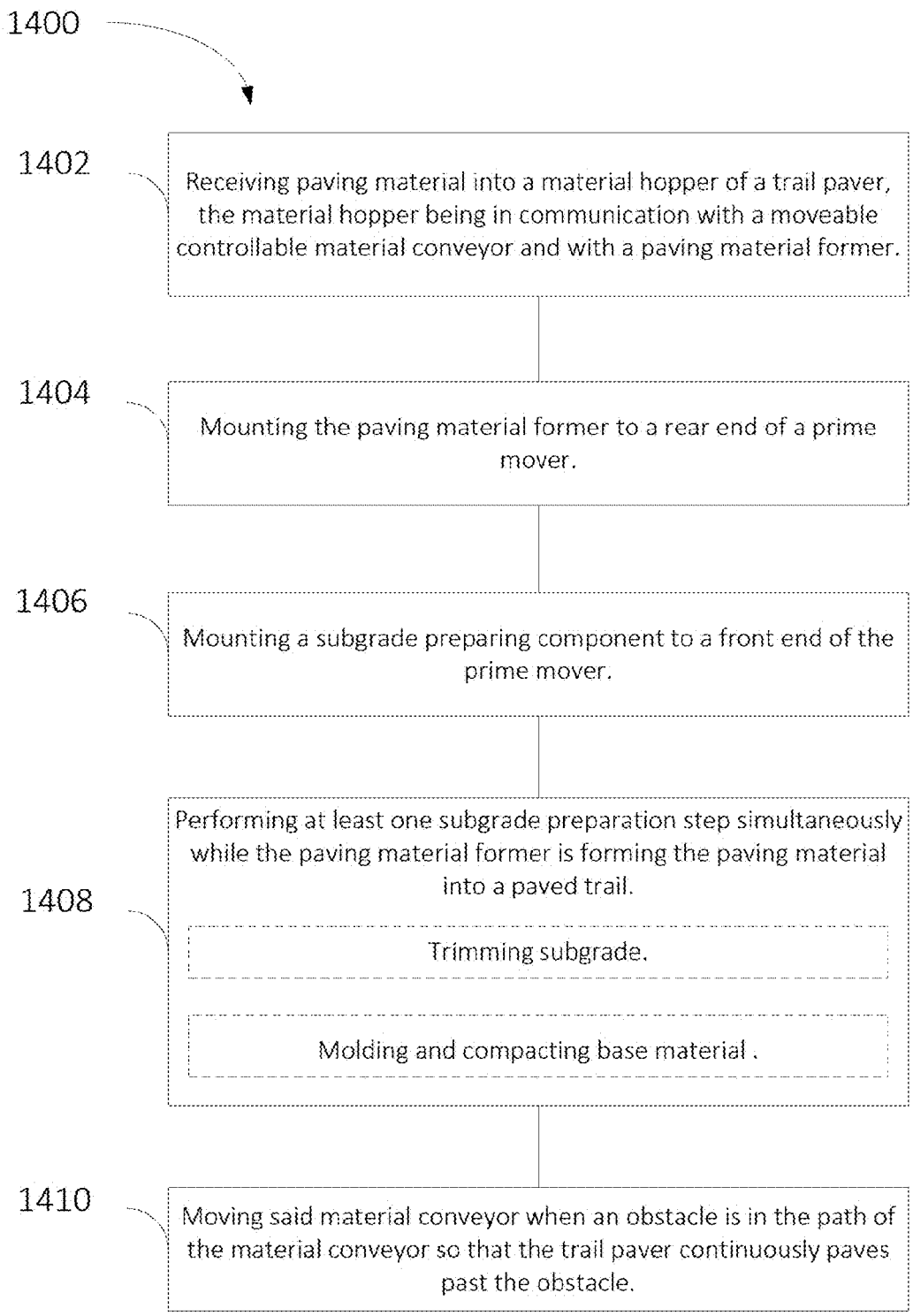
FIG. 14 shows a flow diagram according to embodiments depicting a method for paving.

FIGS. 8, 13, and 14 illustrate flow diagrams depicting processes 800, 1300, and 1400 for paving, including continuous adjustable width paving, in accordance with one or more embodiments of the present disclosure.

In step 802, the adjustable width trail paver is configured and assembled for adjustable width and continuous paving. For example, a set of program instructions are uploaded into the operator control 112. This set of program instructions are configured to enable automatic, partially-automatic, or manual operation of the adjustable width trail paver. The instructions are further configured so that when the adjustable width trail paver is operated manually, the operator control 112 will communicate warning signals to the operator when the adjustable width paver enters an undesirable state. For example, the control 112 is configured so that when operated manually the control 112 continues to monitor various characteristics of the trail paver, including but not limited, fuel levels, paving material levels in the discharge hopper 122, speed, and paving dimensions (e.g., depth, width, height, etc.). The warning signals are communicated by the control 112 to warn the operator of an imminent undesirable state, including but not limited to, low fuel level, low paving material level in the discharge hopper 122 (see, for example, step 1306), too high or low speed, and inaccurate paving dimensions.

In embodiments, the control 112 is further configured so that the adjustable width paving machine operates automatically. This mode of operation requires more extensive pre-operation configuring of the set of program instructions uploaded to the operator control 112. For example, the instructions uploaded must be configured with surveying information (e.g., current grades and elevations, and desired grades and elevations), subgrade or subbase preparation information (e.g., trimming grades, aggregate base type, speed of pan vibrators, base mold dimensions, and speed of spreader, etc.), operating information (e.g., whether or not a stringline or stringless guidance system will be used, where the guidance sensors will be attached to the trail paver, degrees of accuracy desired throughout various operations, speed of operation, etc.), paving turning radii or curvature in the path to be paved, paving turning radii or curvature thresholds (i.e., the paving radius of turning achievable by the adjustable width trail paver with and without utilizing the pivoting/steerable adjustable width paver features), and paving and finishing information (e.g., paving dimensions to be achieved, such as, height, width and depth; finishing necessary, such as whether the smoothness indicator will be used, the speed of the paving pan vibrators, the dimensions of the finished grade, etc.).

In embodiments, the control 112 is further configured so that the adjustable width paving machine operates partially-automatically. Accordingly, the operator control 112 should be configured to readily switch from automatic to manual operation, while still achieving continuous paving. In order to achieve continuous paving, at least the discharge hopper 122, the conveyor 108, and the operator control 112 will have to be specifically configured to enable continuous paving while the conveyor 108 is folded and moved around obstacles (see, for example, step 1306). This can be done by communicatively coupling the discharge hopper 122 and the conveyor 108 to the operator control 112.

Still in step 802, the one or more detector of the discharge hopper 122 is configured for communication with the operator control 112. The various operable communication connections between the discharge hopper 122, the conveyor 108, the one or more detector, and the operator control 112 enable the operator control to be further configured to calculate and communicate the amount of paving materials necessary to be loaded into discharge hopper 122 to enable the conveyor 108 to be moved or controlled around an obstacle.

The one or more detector is configured to detect the amount of paving material received in the discharge hopper 122 from a loading truck (see, for example, step 1306). The operator control 112 includes one or more computer, one or more memory storage, and one or more processor operably connected to the control 112. The one or more computer configured for various computations including, but not limited to, computing the amount of paving material needed to continuously pave a given/computed distance based on one or more given/computed paving dimensions independent of the position of the conveyor 108. The one or more memory storage is configured for various storage purposes including, but not limited to, storing the computed amount of paving material needed to cover the given/computed distance for the given/computed paving dimensions. The one or more processor is configured for various processing purposes including, but not limited to, processing the computed amount of paving materials needed to continuously pave a given/computed distance based on one or more given/computed paving dimensions.

In further embodiments, the receiving hopper 128 is configured with one or more detector. The configuration of the receiving hopper detectors further enabling continuous paving around obstacles along the path to be paved. The one or more receiving hopper detector is in operable communication with the operator control 112. The one or more receiving hopper detector is configured to detect the amount of paving material received, which material is communicated to the materials conveyor 108 by way of a discharge opening generally located on a bottom surface of the receiving hopper (see, for example, steps 1302, 1304, and 1402). The detector is further configured to send one or more signals to operator control 112, the one or more signals including information pertaining to the amount of paving material received (e.g., volume or weight of material received).

In embodiments, the operator control 112 is further configured to generate one or more signal and communicate the one or more signal to an operator at the control 112. The signal may include any signal known in the art that would communicate to the operator that the discharge hopper 122 contains enough material to pave a given/computed distance based on one or more given/computed dimensions (i.e., while the conveyor 108 is moved or controlled), or the signal may communicate that the discharge hopper 122 needs more material in order to pave a given/computed distance based on given/computed dimension (i.e., while the conveyor 108 is moved or controlled) (see, for example, step 1306). In embodiments, the signal may also include a communication to the operator control that the turning radius of the trail paver needs to be increased, at which point the operator may place the trail paver in a partial automatic mode (or may temporarily pause paving) and release the locking mount 1008 (i.e., of coordinated turn module 900) so that the pivoting/steerable features of the adjustable width paver 106 are enabled. In further embodiments, the signal from operator control 112 may include a signal that automatically releases the locking mount 1008 so the turning radius of the trail paver is automatically increased by the operator control 112. In embodiments, another locking signal is generated by operator control 112 when the trail paver is again paving straight, the locking signal locks the locking mount 1008 when the steerable/pivoting features of the adjustable width paver 106 are no longer needed.

When the operator control 112 and program instructions are configured, the adjustable width trail paver machine must be assembled according to the mode of operation desired. This includes, but is not limited to, attaching the necessary components. For example, if trimming will be done, attaching the trimmer 202; if base molding and compacting, attaching the base mold 110 (see, steps 1406 and 1408). If the adjustable width trail paver is to be operated in an automatic mode, the stringless guidance system must be assembled, including attaching the prism poles 704 and the sensors 706 and 708. If stringline guidance is desired, then the stringline sensors are attached. In embodiments, the adjustable width trail paver is configured and assembled with slipform or interchangeable molds so that varying widths can be achieved by assembling the trail paver with the correctly dimensioned mold.

The configuration and assembly listed above for automatic and manual operation is meant to be for illustrative purposes only. Thus, the examples are non-limiting and other configurations not specifically disclosed, but known to those skilled in the art, are contemplated in step 802.

In step 804, the subbase or subgrade is analyzed to determine if one-, two-, or three-pass paving is attainable. Also in step 804, the adjustable width trail paver is operated manually, automatically, or partially-automatically to perform the subgrade and subbase material preparation. For example, in embodiments, the subgrade is analyzed and determined to be of a composition/dimension which requires trimming. Thus, the trimmer 202 is attached together with the adjustable width paver 106 to the prime mover 104, and the adjustable width trail paver is operated in such a way that the trimmer 202 precedes (i.e., trimmer is in front of) the adjustable width paver 106 and paving (see, for example, steps 1404, 1406, and 1408).

In embodiments, the subgrade is analyzed and determined to be of a composition/dimension which requires at least one layer of subbase or subgrade material (e.g., aggregate base). Thus, the base mold 110 is attached together with the adjustable width paver 106 to the prime mover 104, the adjustable width trail paver is operated in such a way that the base mold 110 precedes (i.e., base mold is in front of) the adjustable width paver 106 and paving (see, for example, steps 1404, 1406, and 1408).

In embodiments of step 804, the subgrade or subbase is analyzed. The results of the analysis indicating that one-, two-, or three-pass paving may be achieved. For example, the analysis indicates that the subgrade is of such a composition and consistency that after precise trimming by trimmer 202 paving material may be placed directly on the trimmed surface. So, after the analysis, the trimmer 202 and adjustable width paver 106 are attached and configured with the prime mover 104 to achieve simultaneous or substantially simultaneous one-pass trimming and paving (see, for example, steps 1406 and 1408). "Substantially simultaneous" only because there is a slight delay between the trimming and paving resulting from the width of machine between the front end of the trail paver (where the trimmer operates) and the rear end of the trail paver (where the adjustable width trail paver operates).

In embodiments of step 804, after the analysis of the subgrade/subbase, it is determined that trimming is not necessary (i.e., either trimming has already been done or the subgrade otherwise is in a near-complete state). However, the analysis indicates that gravel, aggregate base, or other subbase/subgrade material will be necessary before paving. So, after the analysis the layer of subgrade/subbase (gravel, aggregate base, etc.) material is laid in the path to be paved. Next, the base mold 110 and adjustable width paver 106 are attached and configured with prime mover 104 to achieve simultaneous or substantially simultaneous one-pass base molding/compacting and paving (see, for example, steps 1406 and 1408).

In embodiments, both trimming and molding/compacting of subbase/subgrade material is determined to be necessary. Thus, in these embodiments, the adjustable width paver 106, the prime mover 104, the base mold 110, and the trimmer 202 are further configured in one or more configurations, which will be obvious to those skilled in the art, to achieve two- to three-pass paving, or more.

In step 806, the adjustable width trail paver is operated to perform continuous paving and zero- or minimum-clearance paving near and around obstacles. For example, an operator standing on the folding operator walkway 506 utilizes the pivot, tilt, raise, or fold features of the operator control 112 to control or move the materials conveyor 108 around obstacles that are near the path to be paved. This allows the loading trucks almost continuous access to the conveyor 108 during the paving operation ("almost continuous" because the trucks will not have access as the conveyor 108 is being controlled or moved around obstacles, see, for example, step 1410). In embodiments, the operator utilizes the program instructions configured in operator control 112 to monitor the movement of materials conveyor 108. Additionally, the operator may monitor a number of components or variables, including, but not limited to, the amount of material present in the discharge hopper 122 while the conveyor is controlled or moved around obstacles (see, for example, steps 1310 and 1410). This monitoring together with the configuration of the instructions in the operator control 112 allow the adjustable width trail paver to continuously pave with zero- to minimum-clearance around or near obstacles along the path to be paved.

In embodiments, the obstacles' positions are stored in an obstacle database in a memory storage of operator control 112. The obstacles' positions are accessed by operator control 112 when the adjustable width trail paver is operating in an automatic or partially-automatic mode. By accessing the obstacles' positions, the operator control 112 can then initiate, actuate, and control the movement of the materials conveyor 108 around the obstacles along the path to be paved. Additionally, by accessing the obstacles' positions, the operator control 112 may then initiate, actuate, and control/steer the pivoting adjustable width paver 106 around obstacles along the path to be paved.

Still in step 806, an operator adjusts and controls generally parallel opposed pressure compensated side plates 502 and 504 and a compaction pan 512. The pressure compensated side plates 502 and 504 help ensure accurate dimensions and finishing and the compaction pan 512 ensures proper compaction of the subbase/subgrade materials, or of the paving material. In embodiments, the operator adjustment is during, or immediately before, the operation of the paving machine.

Still in step 806, an operator steers or controls the pivoting adjustable width paver 106 (or the paving mold/pan of the paver). The pivoting of adjustable width paver is steered or controlled to achieve precise paving radii.

In embodiments, the pressure compensated side plates 502 and 504 assume the general shape of a paving pan. In further embodiments, the pressure compensated side plates 502 and 504 are used in conjunction with a paving pan to provide additional support to the paving pan.

In embodiments, the operator adjustment and control takes place during or prior to the configuration step 802, so that during the operating step 806 the adjustment and control occurs automatically by programmed instructions uploaded and configured in operator control 112. In embodiments, the adjustment and control of the pressure compensated side plates 502 and 504 is achieved hydraulically. In embodiments the adjustment and control of the pressure compensated side plates 502 and 504 are accomplished by the operator control 112 when the adjustable width trail paver operates in either an automatic or partially-automatic mode. Additionally, the operation of the compaction pan is also automatically or partially-automatically controlled by operator control 112. In further embodiments, any of the paving components disclosed are configured to be operated manually, automatically, or partially-automatically.

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

We claim:

1. A method for continuously paving a trail between obstacles using an adjustable width trail paver comprising:

steering and moving a frame with a prime mover between obstacles along an area to be paved, said frame having a first side, a second side, a front, and a rear;

receiving paving material onto a moveable controllable material conveyor, said material conveyor being moveably connected to said frame and having a paving material conveyor drive for controllably and operatively moving said material conveyor to receive paving material from at least the first side and the second side and moving said material conveyor into a position to avoid an obstacle as said trail paver paves past said obstacle;

receiving paving material into a material hopper that is in communication with the material conveyor, said material hopper having an input and an output, said input receiving paving material from the material conveyor and said output associated with an adjustable width paver for feeding paving material into said adjustable width paver, wherein said adjustable width paver is attached to said frame and has a width substantially equal to said frame;

configuring said material hopper to detect the amount of paving material received, indicate that more or less paving material is needed to pave around said obstacle, and discharge paving material to said adjustable width paver;

receiving paving material into the adjustable width paver to form a paved trail of widths from one meter to four meters; and moving said material conveyor when said obstacle is in a path of the material conveyor.

2. The method of claim 1, wherein discharging paving material to said adjustable width trail paver includes varying the speed at which the adjustable width trail paver receives the paving material to help provide constant and even communication of paving material to a path to be paved.

3. The method of claim 1, wherein receiving paving material onto said material conveyor includes varying a speed at which the material conveyor communicates paving material to said material hopper, the speed varied according to adjustable factors, said adjustable factors including different paving trail dimensions, speed of operation, and composition of the paving material.

4. The method of claim 1, wherein indicating whether more or less paving material is needed to pave around the obstacle is based on at least one of: position of the obstacle, a time at which the obstacle enters the path of the material conveyor, and an average time to move said material conveyor around the obstacle based on one or more given dimensions.

5. The method of claim 1, wherein indicating whether more or less paving material is needed to pave around the obstacle is based on one or more dimensions over which said material conveyor will be moved, the one or more dimensions including height, width, and degree to which the material conveyor will be moved.

6. The method of claim 1, wherein the material hopper comprises a plurality of hoppers in series, the plurality of hoppers comprising at least a receiving hopper and a discharge hopper, the receiving hopper located with respect to the material conveyor and the discharge hopper located with respect to the adjustable width paver.

7. The method of claim 1, wherein moving said material conveyor when said obstacle is in a path of the material conveyor comprises at least one of: rotating said material conveyor from 1 degree to (1°) to ninety degrees (90°) from either the first side or the second side of the frame of the trail paver, elevating said material conveyor from 2 centimeters to 31 centimeters, tilting said material conveyor from 1 degree (1°) to 45 degrees (45°), and folding said material conveyor at least 160° towards the frame of the trail paver.

8. A method for one-pass, or multiple-pass paving a trail between obstacles comprising:

steering and moving a frame of a trail paver with a prime mover between obstacles along an area to be paved and in a paving direction, said frame having a first side, a second side, a front, and a rear;

receiving paving material onto a moveable controllable material conveyor, said material conveyor being moveably connected to said frame and having a paving material conveyor drive for controllably and operatively moving said material conveyor to receive paving material from at least the first side and the second side and moving said material conveyor into a position to avoid an obstacle as said trail paver paves past said obstacle;

receiving paving material into a material hopper of the trail paver, said material hopper having an input and an output, said input receiving paving material from the material conveyor and said output associated with an adjustable width paver for feeding paving material into said adjustable width paver, wherein said adjustable width paver is attached to the rear of said frame and has a width substantially equal to said frame;

mounting a subgrade preparing component to a front end of said prime mover;

configuring said material hopper to receive sufficient paving material to pave past said obstacle while the material conveyor is being moved or controlled around said obstacle;

performing at least one subgrade preparation step simultaneously while the adjustable width paver is forming the paving material into a paved trail; and moving said material conveyor into the position when said obstacle is in a path of the material conveyor so that the trail paver continuously paves past the obstacle.

9. The method of claim 8, wherein:

mounting a subgrade preparing component to a front end of said prime mover comprises mounting a trimmer to said front end of said prime mover.

10. The method of claim 8, wherein performing at least one subgrade preparation step comprises performing a trimming subgrade preparation step substantially simultaneously with paving.

11. The method of claim 8, wherein:

mounting a subgrade preparing component to a front end of said prime mover comprises mounting a base mold to said front end of said prime mover.

12. The method of claim 8, wherein performing at least one subgrade preparation step comprises molding and compacting base material substantially simultaneously with paving.

13. The method of claim 8, wherein moving said material conveyor into the position when said obstacle is in a path of the material conveyor comprises at least automatic or partially automatic rotational movement, tilt movement, and folding movement.

14. A method for adjustable width trail paving between obstacles comprising:

steering and moving a frame with a prime mover between obstacles along an area to be paved, said frame having a first side, a second side, a front, and a rear;

receiving paving material by a material conveyor of a trail paver, said material conveyor being moveably connected to said frame and having a paving material conveyor drive for controllably and operatively moving said material conveyor to receive paving material from at least the first side and the second side and moving said material conveyor into a position to avoid an obstacle;

receiving paving material into a material hopper that is in communication with the moveable controllable material conveyor, said material hopper having an input and an output, said input receiving paving material from the material conveyor and said output associated with an adjustable width paver for feeding paving material into said adjustable width paver, wherein said adjustable width paver is attached to said frame and has a width substantially equal to said frame;

configuring said material hopper to receive sufficient material to enable continuous paving while said material conveyor is being moved or controlled around said obstacle as said trail paver paves past said obstacle;

receiving paving material into the adjustable width paver to form a paved trail of widths from one meter to four meters;

adjusting one or more component widths to form the paved trail widths;

rotating, tilting, or folding said material conveyor when said obstacle is in a path of the material conveyor; and forming paving materials according to one or more predetermined dimensions to form the paved trail.

15. The method of claim 14, wherein adjusting one or more component widths comprises a) adjusting horizontally from 2 centimeters to 100 centimeters at least one of: a frame of said adjustable width trail paver, a front steering track, and a rear track drive assembly, or b) hydraulically adjusting a width of one or more pressure compensated side plates of said adjustable width paver.

16. The method of claim 14, wherein configuring said material hopper to receive sufficient material to enable continuous paving while said material conveyor is being moved or controlled around said obstacle comprises:

detecting an amount of paving material received, indicating that more or less paving material is needed to pave around said obstacle, and discharging paving material to the adjustable width paver.

17. The method of claim 14, wherein the trail paver is configured for at least one-, two-, or three-pass paving when the trail paver comprises a subgrade preparing component connected to a front end of a prime mover to at least partially prepare subgrade substantially simultaneously with paving.

18. The method of claim 14, further comprising:

pivoting said adjustable width paver to increase a radius of curvature being paved; and locking said adjustable width paver in a straight paving position when the pivoting of the adjustable width paver is no longer needed.

19. The method of claim 14, wherein adjusting one or more component widths further comprises laterally expanding said adjustable width paver and utilizing paving inserts, including paving pan inserts, to accommodate for the lateral expansion, the paving pan inserts having varying widths from 1 centimeter to 16 centimeters wide.

20. The method of claim 14, further comprising:

adjusting, respectively, discharge speeds or receiving speeds of the material hopper when the material conveyor is moved or will be moved around said obstacle.

* * * * *